US007415239B2

(12) United States Patent
Saito et al.

(10) Patent No.: US 7,415,239 B2
(45) Date of Patent: Aug. 19, 2008

(54) CONVEYING APPARATUS AND RECORDING APPARATUS HAVING THE SAME

(75) Inventors: Hiroyuki Saito, Yokohama (JP); Motoyuki Taguchi, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 11/189,345

(22) Filed: Jul. 26, 2005

(65) Prior Publication Data

US 2006/0024113 A1 Feb. 2, 2006

(30) Foreign Application Priority Data

Jul. 28, 2004 (JP) ..... 2004-220385

(51) Int. Cl.
*B65H 5/06* (2006.01)

(52) U.S. Cl. ..... 399/388; 399/381; 399/396; 271/3.14; 271/270; 347/101; 347/104; 347/153

(58) Field of Classification Search ..... 400/578; 271/3.17, 3.18, 3.19, 270, 176, 7, 10.2, 10.3, 271/3.14, 8.1, 264, 265.01, 265.02, 265.03, 271/265.04, 266; 347/19, 16, 104, 1, 5, 101, 347/105, 106, 111, 112, 153; 101/116, 477; 226/4, 113, 40; 242/333, 326; 399/298
See application file for complete search history.

(56) References Cited

U.S. PATENT DOCUMENTS 3,586,222 A * 6/1971 Rosen ..... 226/1
4,146,922 A * 3/1979 Brown et al. ..... 700/69
4,331,328 A * 5/1982 Fasig ..... 271/270
4,514,955 A * 5/1985 Mouser et al. ..... 53/64
4,551,664 A * 11/1985 Wong et al. ..... 318/592
4,803,522 A * 2/1989 Sasaki ..... 355/26
4,933,727 A * 6/1990 Mizuma et al. ..... 399/298
4,988,935 A * 1/1991 York ..... 318/568.18
5,127,509 A * 7/1992 Kohlen et al. ..... 198/345.3
5,127,642 A * 7/1992 Takimoto et al. ..... 271/3.19
5,228,680 A * 7/1993 Sugiura ..... 271/259
5,398,221 A * 3/1995 Ogawa ..... 369/30.15
5,674,019 A * 10/1997 Munakata et al. ..... 400/568
5,709,331 A * 1/1998 Lam et al. ..... 226/4
6,005,687 A * 12/1999 Kawashima et al. ..... 358/498

(Continued)

FOREIGN PATENT DOCUMENTS

JP 08259101 A * 10/1996

(Continued)

*Primary Examiner*—Daniel J. Colilla
*Assistant Examiner*—Wynn Q Ha
(74) *Attorney, Agent, or Firm*—Canon USA Inc IP Div

(57) ABSTRACT

A conveying apparatus which synchronously conveys a conveyed object includes a first conveyance roller disposed at a downstream side of a conveyance path for conveyance of the conveyed object and a second conveyance roller disposed at an upstream side of the conveyance path, a first driving unit and a second driving unit for independently driving the first conveyance roller and the second conveyance roller, respectively, and a control unit for performing feedback control of the first driving unit and the second driving unit on the basis of amounts of rotation of the first conveyance roller and the second conveyance roller, respectively. The control unit defines a setting of driving control for the second conveyance roller different from driving of the first conveyance roller.

15 Claims, 17 Drawing Sheets

U.S. PATENT DOCUMENTS

| | | | | |
|---|---|---|---|---|
| 6,168,333 | B1 * | 1/2001 | Merz et al. | 400/634 |
| 6,378,694 | B1 * | 4/2002 | Onoyama et al. | 198/781.06 |
| 6,530,569 | B2 * | 3/2003 | Yamagishi | 271/270 |
| 6,554,395 | B2 * | 4/2003 | Cole et al. | 347/37 |
| 6,729,712 | B2 | 5/2004 | Kobayashi et al. | 347/19 |
| 6,823,132 | B2 * | 11/2004 | Saito et al. | 388/806 |
| 6,838,855 | B2 * | 1/2005 | Kobayashi et al. | 318/800 |
| 6,983,686 | B2 * | 1/2006 | Vaughn et al. | 101/32 |
| 7,019,481 | B2 * | 3/2006 | Kato et al. | 318/610 |
| 2002/0172511 | A1 * | 11/2002 | Saito et al. | 388/800 |
| 2002/0191305 | A1 | 12/2002 | Nagatoshi | |
| 2003/0062867 | A1 * | 4/2003 | Kobayashi | 318/560 |

FOREIGN PATENT DOCUMENTS

| | | | | |
|---|---|---|---|---|
| JP | 11268844 | A | * | 10/1999 |
| JP | 2004196483 | A | * | 7/2004 |
| JP | 2006036490 | A | * | 2/2006 |

* cited by examiner

CONVEYING APPARATUS AND RECORDING APPARATUS HAVING THE SAME

BACKGROUND OF THE INVENTION

1. Field of the Invention

The present invention relates to a conveying apparatus for conveying a conveyed object, and more particularly to control of conveyance of a recording medium in a recording apparatus for recording on the recording medium.

2. Description of the Related Art

In recent years, an inkjet recording apparatus has made a remarkable progress, and high image quality printing, high speed printing, and printing with lower operation noise have rapidly progressed. In addition, there has been notable growth in a number of users, and accordingly, the inkjet recording apparatus has been used in various ways. Conventionally, in order to achieve high image quality printing, it is preferable that a sheet is fed from an upper cassette, in which the bending of printing paper is reduced to a minimum. On the other hand, in order to stack a large amount of sheets of ordinary paper for printing, it is preferable that the sheet is fed from a U-turn cassette. With regard to feeding from the upper cassette, efforts have been made so that both high-quality paper and ordinary paper can be used, however, with regard to feeding from the U-turn cassette feeding, enough attempt has not been made in order to use the high-quality paper.

Especially, with regard to the feeding from the U-turn cassette, a conveyance resistance (conveyance load) increases due to an effect of stiffness of the printing paper, because the paper is reversed between feeding and printing. In this situation, in order to carry out printing conveyance of the high-quality paper, it is necessary to reduce the conveyance resistance by expanding the size of a conveyance path in which the sheet is U-turned, or otherwise, it is recommendable to use a high-quality paper of weak stiffness. In addition, there are some cases in which degradation of image quality is permitted to some extent.

A conventional U-turn conveyance mechanism includes a conveyance roller (hereinafter referred to as an LF conveyance roller), which is positioned upstream of a recording head in the vicinity thereof, and a U-turn conveyance roller for conveying a recording paper through a U-turn shaped conveyance path. In the conventional U-turn conveyance mechanism, each of the rollers is gear-coupled by a common conveyance motor to mechanically carry out a synchronized conveyance.

As for a driving motor, a DC motor is often used, in order to simultaneously achieve both silent and high speed printing. A rotation amount of the LF conveyance roller and the U-turn conveyance roller is detected by one encoder sensor, and one driving motor, which is a DC motor, is feedback-controlled on the basis of an output signal outputted by the encoder sensor.

Besides, a recording apparatus in which one conveying medium is conveyed by using a plurality of motors and rollers is adopted by a page printer. In such an apparatus, the plurality of rollers are continuously fed while the conveyance medium is being conveyed. Besides, a tension value of the conveying medium detected by a unit for detecting a tension, which is arranged between the rollers, is controlled to be constant.

In an apparatus as disclosed in the U.S. Pat. No. 6,729,712, in order to carry out a recording operation with a high speed in a serial printer, in a case where the DC motor driving a carriage and a DC motor driving a conveyance section are driven in parallel for a prescribed period of time, a drive startup timing of the DC motor driving the carriage is controlled in accordance with the operation of the conveyance section. In addition, because different sources of driving are employed for a feeding operation, and a printing and conveying operation, the recording paper is synchronously fed to the position at which printing starts, by simultaneously operating a feeding roller, and a printing and conveying roller. This is because action of delivering the sheet from the feeding roller to the printing and conveying roller is necessary. However, in the printing and conveying operation, in which good accuracy is most demanded among operations of the inkjet recording apparatus, no attempt has been made to implement a synchronous feeding by feedback control driving using a plurality of DC motors in the printing and conveying in the relatively long conveyance path, such as U-turn conveyance and the like.

However, in a conventional U-turn conveyance and printing, an effect of the conveyance resistance generated when a sheet of strong stiffness is conveyed in the U-turn path cannot be overcome. As a result, degradation of image quality occurs because a desired amount of sheet cannot be conveyed by the LF conveyance roller. In addition, in a case where the U-turn conveyance path having a large diameter is employed, the size of the apparatus body becomes large, and accordingly, a manufacturing cost is increased. Besides, the apparatus of a large size itself cannot be accepted by its user.

Further, the conveyance resistance (conveyance load) generated due to stiffness of the paper sheet varies much depending on the position in the conveyance path at which the trailing edge of the printing sheet exists. Thus, in a constitution in which one driving motor simultaneously drives both the LF conveyance roller and the U-turn conveyance roller, if the conveyance resistance in the U-turn conveyance path is high, the sheet conveyance amount at the U-turn conveyance roller decreases. Thus, the conveyance resistance applied to the LF conveyance roller increases and results in decrease in the conveyance amount at the LF conveyance roller. In addition, both the U-turn conveyance roller and the LF conveyance roller pull the paper sheet between them. On the contrary, if the conveyance resistance in the U-turn conveyance path is low, the sheet conveyance amount at the U-turn conveyance roller increases. Thus, the conveyance resistance applied to the LF conveyance roller decreases and results in increase in the conveyance amount at the LF conveyance roller. In addition, both the U-turn conveyance roller and the LF conveyance roller push the paper sheet between them. Further, there is much difference in the conveyance resistance between when both the U-turn conveyance roller and the LF conveyance roller convey the paper sheet and when only the LF conveyance roller conveys the paper sheet after the trailing edge of the sheet passes the nip of the U-turn conveyance roller. That is, the conveyance resistance changes significantly at the boundary of the regions. Therefore, the conveyance amount by the LF conveyance roller varies correspondingly, which causes remarkable image unevenness.

Further, because the same form of conveyance is employed for both the paper sheet of strong stiffness and the paper sheet of weak stiffness, it is difficult to use both types of paper sheet in a manner suitable to both types.

In addition, in a conveyance form which includes a constant feed control having the tension detection section, an apparatus such as the serial printer performs an intermittent feeding in which stop and startup is repeated. However, in the intermittent feeding, a good and sufficient control cannot be achieved because the cost of the tension detection section is increased, and additionally the period of variance of the tension is short, and its variance is abrupt.

In addition, as a method for synchronously operating a plurality of driving sources which can easily be thought of, there is a method in which a synchronization control of the plurality of motors is carried out by feed-forward control of a pulse motor. In this case, in conveying one sheet of recording paper with two motors, external disturbance is applied to the sheet because each of the motors performs driving regardless of the state of the other motor. Thus, it becomes difficult to obtain an appropriate conveyance accuracy.

Further, in a case of simultaneously operating the DC motors, operation errors are relatively permitted even when there occurs difference in the operation of the motors.

The above problems have been getting more difficult to overcome under the situation in which printing on a thick high-quality printing paper with strong stiffness is demanded while high image quality printing has been recently developed, because of the effect of external force due to bending stiffness and the friction resistance of the printing paper.

SUMMARY OF THE INVENTION

The present invention is directed to implementing a synchronized sheet conveyance with high accuracy by carrying out a driving control using a plurality of motors to eliminate an affect of a conveyance resistance generated in a conveyance path. In a recording apparatus, the present invention is directed to carrying out a conveyance of recording paper with high accuracy.

In one aspect of the present invention, a recording apparatus for conveying a recording medium by using a plurality of conveyance units in order to carry out recording on the recording medium by using a recording head comprises a first conveyance roller disposed at a downstream side of a conveyance path for conveyance of the recording medium and a second conveyance roller disposed at an upstream side of the conveyance path, a first driving unit and a second driving unit configured to independently drive the first conveyance roller and the second conveyance roller, respectively, and a control unit configured to perform feedback control of the first driving unit and the second driving unit on the basis of amounts of rotation of the first conveyance roller and the second conveyance roller, respectively, wherein the control unit defines a setting of driving control for the second conveyance roller different from a setting of driving control of the first conveyance roller.

In another aspect of the present invention, a conveying apparatus for conveying a conveyed object by synchronizing a plurality of conveyance units comprises a first conveyance roller disposed at a downstream side of a conveyance path for conveyance of the conveyed object and a second conveyance roller disposed at an upstream side of the conveyance path, a first driving unit and a second driving unit configured to independently drive the first conveyance roller and the second conveyance roller, respectively, and a control unit configured to perform feedback control of the first driving unit and the second driving unit on the basis of amounts of rotation of the first conveyance roller and the second conveyance roller, respectively, wherein the control unit defines a setting of driving control for the second conveyance roller different from a setting of driving control of the first conveyance roller.

According to the above configurations, it is possible to minimize the affect of external disturbance which the conveyance roller disposed at the downstream side of the conveyance path receives due to the conveyance resistance in the conveyance path, by controlling driving of the conveyance roller disposed at the upstream side of the conveyance path. In addition, it is possible to achieve stabilization of the movement of recording paper due to the conveyance resistance.

Further features of the present invention will become apparent from the following detailed description of exemplary embodiments with reference to the attached drawings.

BRIEF DESCRIPTION OF THE DRAWINGS

The accompanying drawings, which are incorporated in and constitute a part of the specification, illustrate embodiments of the invention and, together with the description, serve to explain the principles of the invention.

DETAILED DESCRIPTION OF THE EMBODIMENTS

Embodiments of the invention will be described in detail below with reference to the drawings.

First Embodiment

Figure 1:
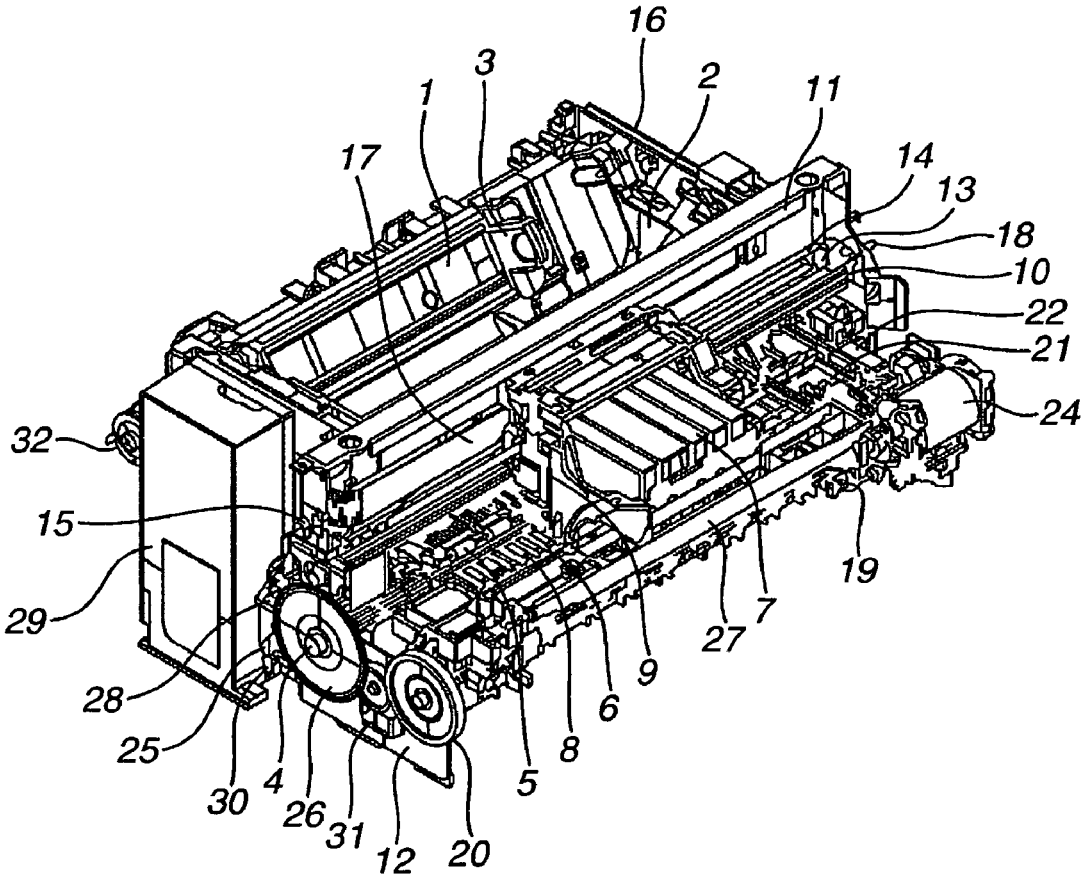
FIG. 1 is a perspective view of a mechanical section according to an embodiment of the present invention.
Figure 2:
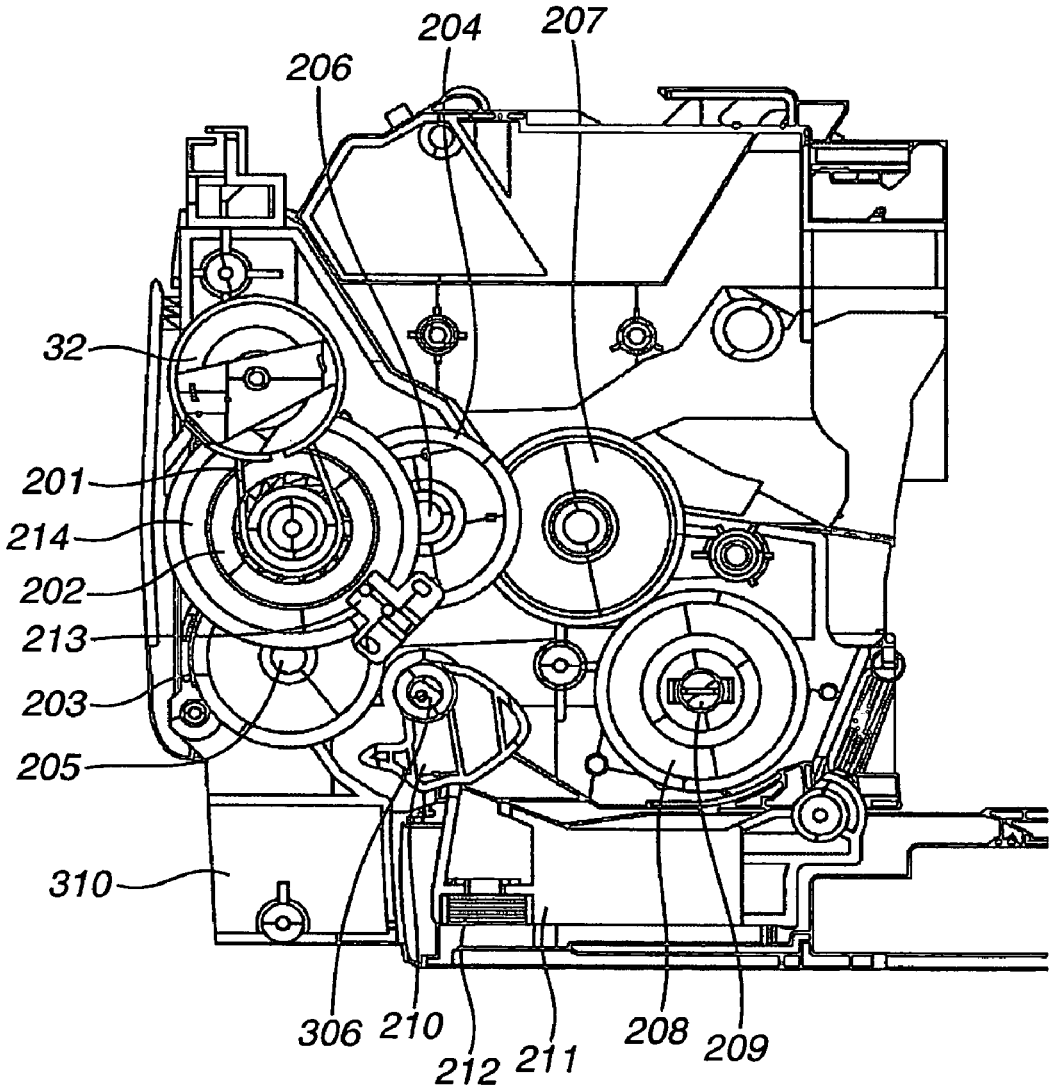
FIG. 2 is a cross-sectional view showing a conveyance driving section according to the embodiment.
Figure 3:
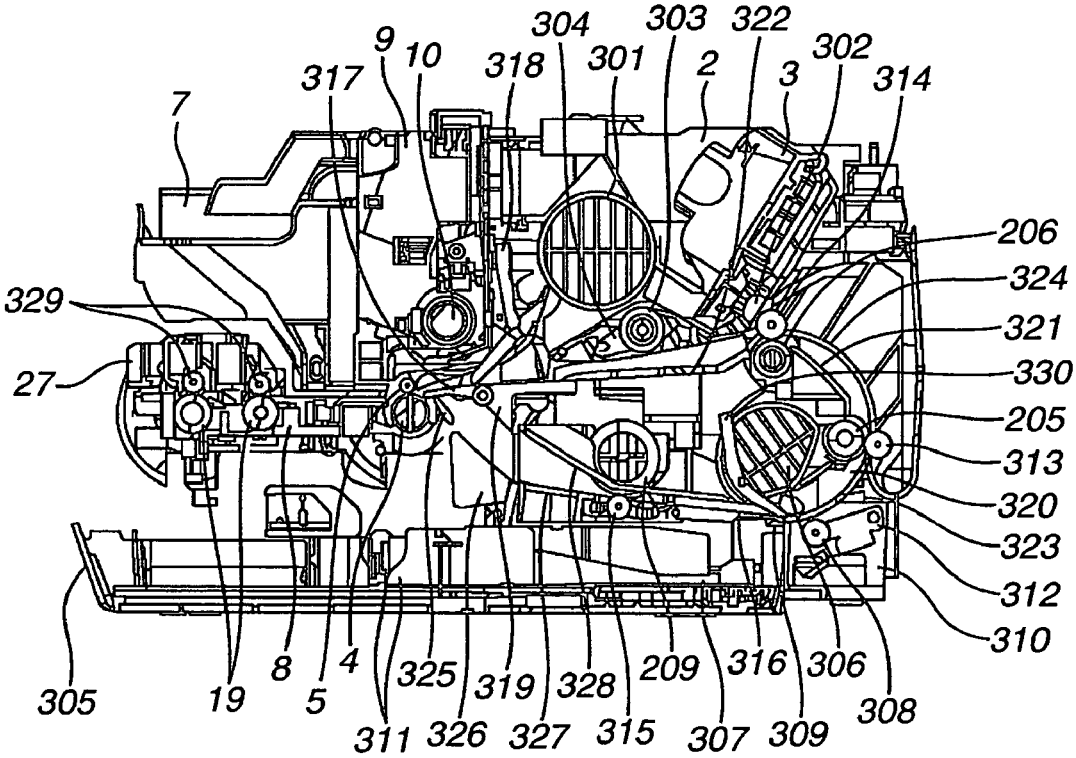
FIG. 3 is a cross-sectional view showing a conveyance section according to the embodiment.

FIG. 1 is a perspective view showing a whole constitution of a recording apparatus in accordance with a first embodiment of the present invention. FIG. 2 is a section view of sheet conveyance driving system in the first embodiment of the present invention. FIG. 3 is a section view of a sheet conveyance system in the first embodiment of the present invention.

The recording apparatus is constituted by (A) an automatic sheet feed and conveyance unit, (B) a carriage unit, (C) a sheet discharge unit, and (D) a cleaning unit. In this regard, outline of these units is explained in order by referring to each of the items.

(A) Automatic Sheet Feed Unit and Conveyance Unit

The automatic sheet feed and conveyance unit includes two automatic sheet feed sections. Hereafter, an upper automatic feed section is referred to as an ASF sheet feed section, and a lower automatic sheet feed section is referred to as a U-turn sheet feed and cassette sheet feed section.

A-1—ASF Sheet Feed and Conveyance Section

The ASF sheet feed and conveyance section has a constitution in which a pressure plate 1 for loading a recording paper P thereon, a sheet feed roller 301 for feeding the recording paper P, a separation roller 303 for separating the recording paper P, a return lever (not shown) for returning the recording paper P to a loading position, and the like are mounted on an ASF base 2.

The sheet feed roller 301 is circular in cross section, and the recording paper P is fed thereby. A driving force to operate the sheet feed roller 301 is transferred from a motor (not shown) (hereafter referred to as an AP motor), which is used in common with the cleaning unit as described later.

The pressure plate 1 is provided with a side guide 3, which is movably installed, to regulate the loading position of the recording paper P. The pressure plate 1 is rotatable around a rotation axis joined to the ASF base 2, and is urged to the sheet feed roller 301 by the pressure plate spring 302. The pressure plate 1 is constituted so that it can touch and separate from the sheet feed roller 301, by a cam (not shown).

In addition, a separation roller holder 304, to which a separation roller 303 for separating the recording paper P sheet by sheet is attached, is rotatable around the rotation axis provided to the ASF base 2. The separation roller holder 304 is urged to the sheet feed roller 301 by a separation roller spring (not shown). The separation roller 303 is provided with a clutch spring (not shown), and is caused to rotate when a load of a predetermined amount or more is applied. The separation roller 303 can touch and separate from the sheet feed roller 301 by a control cam (not shown).

Besides, the return lever (not shown) for returning the recording paper P to the loading position is rotatably mounted to the base 2. The return lever is rotated by the control cam (not shown) when the recording paper P is returned.

When feeding of the paper sheet is started, first, the separation roller 303 touches the sheet feed roller 301 being driven by the AP motor (not shown). Then, the return lever (not shown) is released and the pressure plate 1 touches the sheet feed roller 301. In this state, the feeding of the recording paper P is started. The recording paper P is conveyed and separated by the nip section, and only a recording paper P at the top is fed.

The fed recording paper P is guided by a pinch roller holder 6, which is provided with an LF pinch roller 5 and also serves as a guide of the recording paper P, and also guided by a paper guide 319, and a guide 317 for switching the sides. The guide 317 is rotatably attached to the paper guide 319 and is lowered during printing. The fed recording paper P is then fed to a roller nip between an LF conveyance roller 4 and the LF pinch roller 5. Here, the LF pinch roller 5 is pressed to the LF conveyance roller 4 by a spring (not shown) to generate a conveyance force. A first sheet position detection sensor lever 318 is rotated by the head edge of the recording paper P conveyed there, a sensor (not shown) for detecting the position of an edge of a sheet detects a position of the head edge of the recording paper by detecting an operation of the lever, and thereby a printing position of the recording paper P is acquired. During printing, the recording paper P is conveyed on a platen 8 by a roller pair of the LF conveyance roller 4 and the LF pinch roller 5.

A-2—U-turn Feeding and Automatic Both Side Conveyance Section

The recording paper P is stored in a cassette 305, which is provided at the front side of the apparatus. In order to separate and feed the recording paper P, a cassette pressure plate 307 for loading the recording paper P and causing the recording paper P to contact a U-turn sheet feed roller 306 is provided to the cassette 305. The sheet feed roller 306 for feeding the recording paper P, the U-turn separation roller 308 for separating the recording paper P, a U-turn return lever 309 for returning the recording paper P to the loading position, and the like, are attached to a U-turn base 310 of the apparatus body.

The U-turn sheet feed roller 306 is semicircular in cross section, and the recording paper P is fed thereby.

The cassette pressure plate 307 is provided with a cassette side guide 311, which can move so as to regulate the loading position of the recording paper P. The cassette pressure plate 307 is rotatable around the rotation axis joined to the cassette 305. The cassette pressure plate 307 is urged to the U-turn sheet feed roller 306 by a cassette arm 211 and a cassette pressure plate spring 212, which are provided on the left and the right side. The cassette pressure plate 307 can touch and separate from the sheet feed roller 306 by a pressure plate cam 210 provided on an axis of the sheet feed roller 306.

Further, the U-turn base 310 is provided with a U-turn separation roller holder 312, to which the U-turn separation roller 308 for separating the recording paper P sheet by sheet is attached. The U-turn separation roller holder 312 is attached rotatably around the rotational axis, and is urged to the sheet feed roller 306 by the separation roller spring (not shown). The U-turn separation roller 308 is provided with a clutch spring (not shown) attached thereto and can be rotated when a load of a predetermined amount or more is applied. The U-turn separation roller 308 can touch and separate from the U-turn sheet feed roller 306 by a control cam (not shown).

The U-turn return lever 309 for returning the recording paper P to the loading position is rotatably attached to the U-turn base 310 and is urged in a releasing direction by a return lever spring (not shown). The U-turn return lever 309 is rotated by the control cam (not shown) when the recording paper P is returned.

In a normal standby state, the cassette pressure plate 307 is released by the pressure plate cam 210, then the U-turn separation roller 308 is released, and the U-turn return lever 309 returns the recording paper P. The U-turn return lever 309 is provided at the loading position to close an aperture for loading, so that the recording paper P does not enter through the aperture. When the feeding is started from this standby state, driven by a second conveyance motor 32, first, the U-turn separation roller 308 touches the U-turn sheet feed roller 306, the U-turn return lever 309 is released, and the cassette pressure plate 307 touches the U-turn sheet feed roller 306. In this state, the feeding of the recording paper P is started. The recording paper P is separated at a nip section of the separation roller 308, and only a recording paper P at the top is fed.

When the separated and conveyed recording paper P reaches a first U-turn conveyance roller 205 and a first U-turn pinch roller 313, the cassette pressure plate 307 is released by the pressure plate cam 210 and the U-turn separation roller 308 is released by the control cam (not shown) and the U-turn return lever 309 returns to the loading position. At this time, the recording paper P which has reached the separation nip section can be returned to the loading position.

At the downstream side of the sheet feeding portion, the two conveyance rollers are provided, namely the first U-turn conveyance roller 205 and the second U-turn conveyance roller 206 for conveying the recording paper P which has been fed and conveyed (hereinafter referred to simply as the U-turn conveyance roller when referring to both of the first and the second U-turn rollers). At the position corresponding to the U-turn conveyance rollers 205 and 206, the first U-turn pinch roller 313 and a second U-turn pinch roller 314 for holding the recording paper P therebetween are attached by a spring axis (not shown) and are urged to each of the U-turn conveyance rollers (hereinafter referred to simply as the U-turn pinch roller when referring to both of the first and the second U-turn pinch rollers). In addition, in order to form a conveyance path, U-turn inner guides 320, 321, and 322 forming the inner side thereof, a U-turn outer guide 323 forming the outer side thereof, a rear guide 324, and a sheet guide section 2*a* on the lower surface of the ASF base 2 are provided.

The confluence of a conveyance path and the aforementioned ASF base 2 is constituted by a rotatable flapper 316 so that the paths of each of the sheet feeding sections can smoothly meet.

The recording paper P which is conveyed by the U-turn conveyance rollers 205 and 206 is conveyed to go into the aforementioned ASF sheet feed path at an upstream position of the first sheet position detection sensor lever 318, and further conveyed and printed.

During printing, the recording paper P is conveyed on the platen 8 by the roller pair of the LF conveyance roller 4. In addition, depending on the region of conveyance, the recording paper P is conveyed on the platen 8 by synchronous feeding of the roller pair of the LF conveyance roller 4 and the roller pairs of the U-turn conveyance rollers 205 and 206. The recording on the recording paper P is carried out by the recording head by scanning a region of the recording paper P positioned on the platen 8. The scanning record of the recording head and the conveyance operation are performed alternately to carry out image recording on the recording paper P.

In addition, a second sheet position detection sensor lever 330 is positioned at the upstream of the U-turn conveyance roller 205, in the direction of conveyance. The rotation operation of the second sheet position detection senor lever 330 when the recording paper P is passing, is detected by a sensor (not shown), thereby the position of the trailing edge of the recording paper P can be detected before the trailing edge of the recording paper P passes the roller pair of the first U-turn conveyance roller 205.

In automatic both side printing, the trailing edge of the recording paper P is conveyed being held again between the LF conveyance roller 4 and the LF pinch roller 5. The recording paper P which is fed again is conveyed being held between a both side conveyance roller 209 and a both side pinch roller 315. Then the recording paper P is guided by a both side switching guide 317 which is rotated upward by a switching mechanism (not shown) to be conveyed into a both side conveyance path. The conveyed recording paper P is guided by the lower surface of the paper guide 319, a both side inner guide 328, both side outer guides 325 and 326, and an under guide 327.

A sheet conveyance path for both side printing is combined with the sheet conveyance path of the aforementioned U-turn conveyance after it passes the flapper 316. Therefore, the constitution and effects of the sheet conveyance path are the same as the aforementioned.

During printing, the recording paper P is conveyed on the platen 8 by the roller pair of the LF conveyance roller 4. In addition, depending on the region of conveyance, the recording paper P is conveyed on the platen 8 by synchronous feeding of the roller pair of the LF conveyance roller 4 and the roller pairs of the U-turn conveyance rollers 205 and 206. Otherwise, the recording paper P is conveyed on the platen 8 by synchronous feeding of the roller pair of the LF conveyance roller 4, the roller pairs of the U-turn conveyance rollers 205 and 206, and the roller pair of the both side conveyance roller 209.

A-3—Driving System of the Conveyance Section

An LF conveyance encoder sensor 28 is attached to a chassis 12. The driving force of an LF conveyance motor 25 is transferred to an LF conveyance roller gear (not shown) which is press-fitted to the LF conveyance roller 4 via an LF conveyance timing belt 30. Feedback control is carried out on the basis of the information on the amount of rotation (speed) of the LF conveyance roller 4 which is obtained by the LF conveyance encoder sensor 28 by reading the number of lines of an LF conveyance encoder scale 26 which is fixed to an LF conveyance roller gear (not shown). Thereby the LF conveyance motor 25 which is a DC motor is rotationally controlled to convey the recording paper P.

On the other hand, with regard to driving of the U-turn conveyance and the automatic both side conveyance, the driving force of a U-turn conveyance motor 32 is transferred to a scale idler gear 202 via a U-turn conveyance timing belt 201 and further transferred to a U-turn conveyance roller gear 203 and a U-turn conveyance roller gear 204 which are respectively fixed to the first U-turn conveyance roller 205 and the second U-turn conveyance roller 206. The rotation of the second U-turn conveyance roller gear 204 is transferred to a both side conveyance roller gear 208, which is fixed to the both side conveyance roller 209, via the idler gear 207. Here, feedback control is carried out on the basis of the information on the amount of rotation (speed) of the first U-turn conveyance roller 205, the second U-turn conveyance roller 206, and the both side conveyance roller 209, which is obtained by the U-turn conveyance encoder sensor 213 by reading the number of lines of the U-turn conveyance encoder scale 214 coaxially fixed to the scale idler gear 202. Thereby the U-turn conveyance motor 32 which is a DC motor is rotationally controlled to convey the recording paper P.

The driving force to the U-turn sheet feed roller 306 is transferred by means of planet gears and the like (not shown) disposed at the downstream side of the conveyance path of the first U-turn conveyance roller 205 and the second U-turn conveyance roller 206.

(B) Carriage Section

The carriage section includes a carriage 9 for attaching a head cartridge 7 thereto. Besides, the carriage 9 is supported by a guide axis 10 for reciprocating scanning in a perpendicular direction in relation to the direction of conveyance of the recording paper P and by a guide rail 11 for holding the upper trailing edge of the carriage 9 which retains the clearance between the recording head and the recording paper P. The guide axis 10 and the guide rail 11 are attached to the chassis 12.

The carriage 9 is driven by a carriage motor 13 which is a DC motor attached to the chassis 12, via a timing belt 14. The timing belt 14 is tensioned and supported by an idle pulley 15. In addition, the carriage 9 is provided with a flexible cable 17 for transmitting a head signal from an electric substrate 16 to the head cartridge 7. Besides, the carriage 9 is equipped with a linear encoder (not shown) for detecting the position of the carriage 9, and the position of the carriage 9 can be detected by reading the number of lines of a linear scale 18 which is attached to the chassis 12. A signal of the linear encoder is transmitted to the electric substrate 16 via the flexible cable 17 to be processed there. The voltage and the current to electrical components are supplied by a power source 29.

In the above constitution, when forming an image on the recording paper P, the abovementioned LF conveyance roller 4 conveys the recording paper P to a line position (the position of the recording paper Pin the direction of conveyance) at which the image is formed, and also the carriage 9 is moved to a row position (the position of the recording paper P perpendicular to the direction of conveyance) at which the image is formed, by feedback control using the carriage motor 13 and the linear encoder, to have the head cartridge 7 opposed to the image forming position. After that, the head cartridge 7, by the signal from the electric substrate 16, ejects an ink to the recording paper P to form the image.

(C) Sheet Discharge Section

In the sheet discharge section, a spur 329, which is fixed to a spur holder 27 with a spring axis (not shown) so that it is rotatably driven by the sheet discharge roller 19. The driving force from an LF conveyance roller gear (not shown) is transferred to the sheet discharge roller 19 via a discharge transfer gear 31 and a discharge roller gear 20. In the above constitution, the recording paper P which is driven and on which an image is formed at the carriage section is conveyed being held between the nip between the discharge roller 19 and the spur 329 and discharged onto a discharge tray and the like (not shown).

(D) Cleaning Section

The cleaning section is constituted by a pump 24 for cleaning the head cartridge 7, a cap 21 for preventing the head cartridge 7 from drying out, a wiper 22 for cleaning the face of the head cartridge 7, and an AP motor (not shown) which is the driving source.

Figure 4:
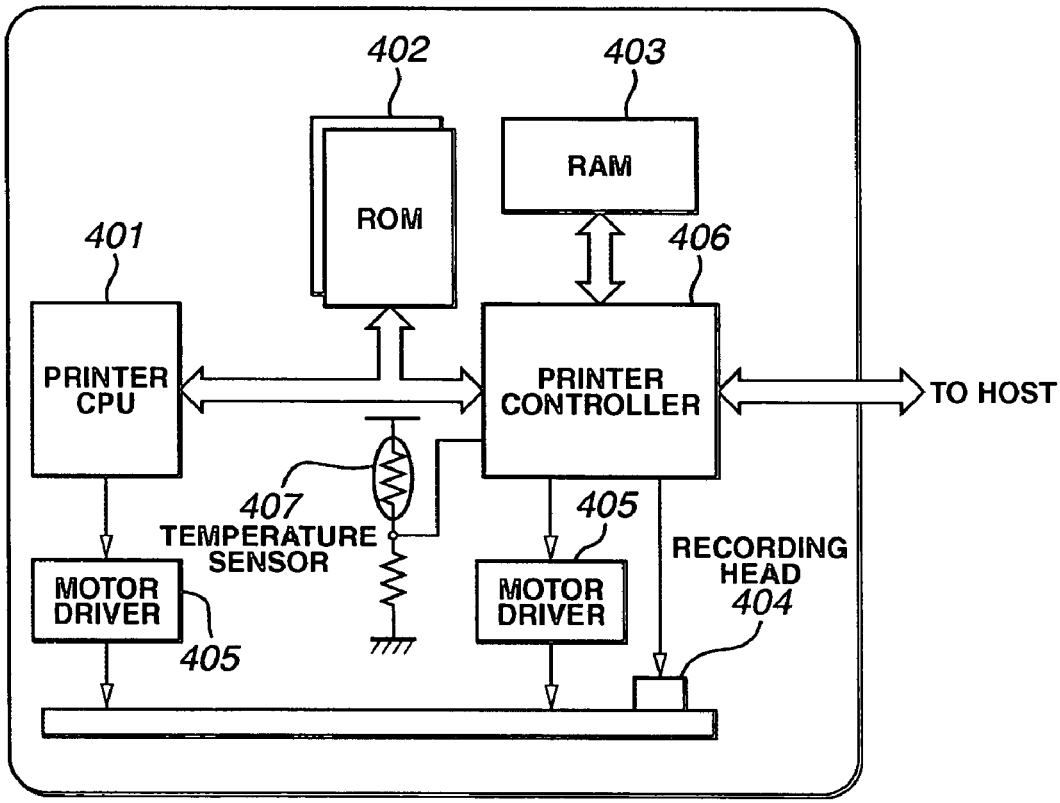
FIG. 4 is a block diagram explaining a detailed constitution of a printer controller according to the embodiment.

FIG. 4 is a block diagram showing the control construction of a printer constituted on the electric substrate 16.

In FIG. 4, reference numeral 401 denotes a CPU for controlling a printer of the recording apparatus, which controls printing processing by utilizing a printer control program, a printer emulation, and printing fonts stored in a ROM 402.

Reference numeral 403 denotes an RAM, which stores rasterized data for printing and received data from the host. Reference numeral 404 denotes a recording head; reference numeral 405 denotes a motor drive for driving a motor; and reference numeral 406 denotes a printer controller, which controls access to the RAM 403, sends and receives data to and from a host apparatus, and sends a control signal to a motor driver. Reference numeral 407 denotes a temperature sensor constituted by a thermistor and the like, which detects the temperature of the recording apparatus.

The CPU 401 mechanically and electrically controls the apparatus main unit by a control program within the ROM 402. In addition, the CPU 401 reads information such as emulation command which is sent from the host apparatus to the recording apparatus, from an I/O data register within the printer controller 406, and writes and reads a control corresponding to the command in the I/O data register and an I/O port within the printer controller 406.

Figure 5:
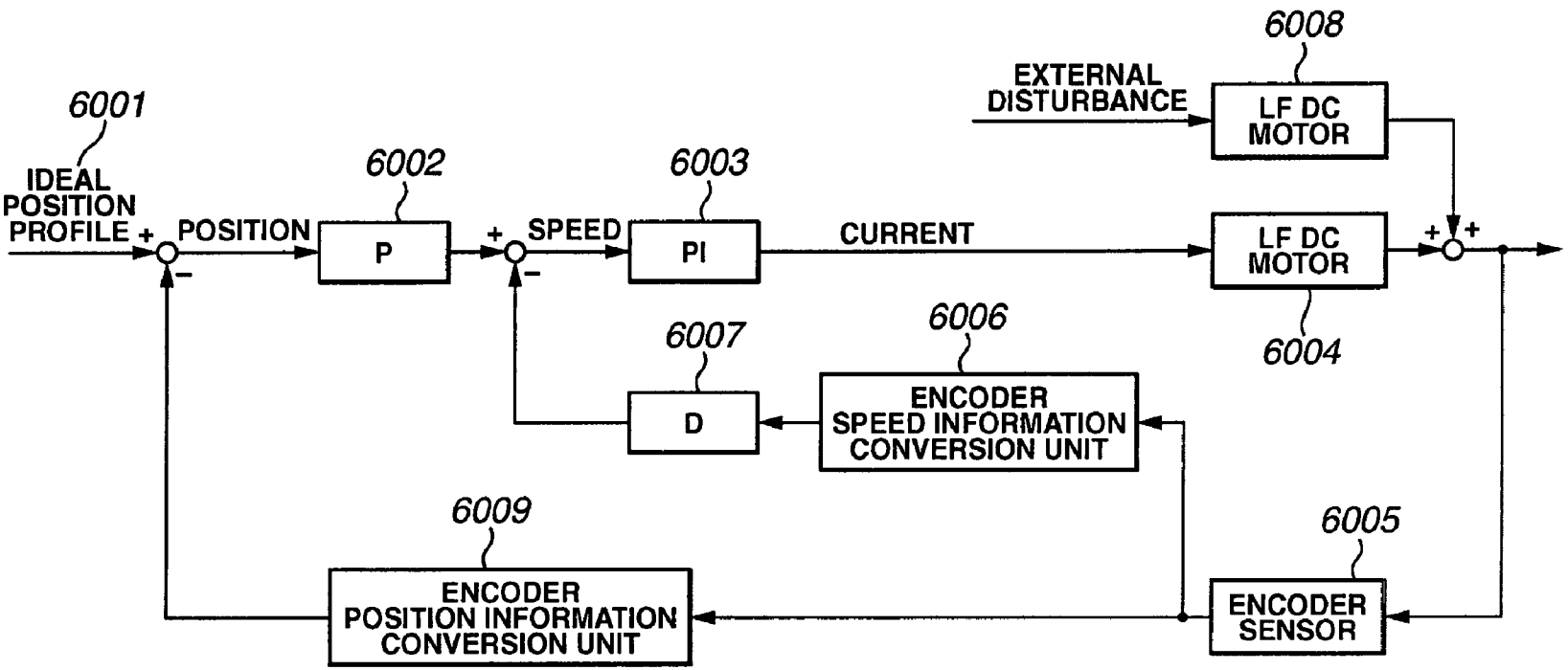
FIG. 5 is a schematic diagram explaining a position control system of a DC motor according to the embodiment.

FIG. 5 is a schematic diagram explaining a position control system of a common DC motor, which shows a method of carrying out a position servo. In this embodiment, the position servo is used in an acceleration control region, a constant speed control region, and a deceleration control region. The DC motor is controlled by a method called "PID (Proportional Integral Differential) control" or "classical control". The method is described below.

First, a target position to be applied to a controlled object is applied in a form of an ideal position profile 6001. In this embodiment, the ideal position profile 6001 corresponds to an absolute position which the sheet conveyed by a line feed motor should reach at a relevant time. The position information varies as the time passes. The driving of this embodiment is carried out by a tracking control to the ideal position profile.

The apparatus is equipped with an encoder sensor 6005, which detects the physical rotation of the motor. An encoder position information conversion section 6009 is a unit for obtaining the absolute position information by adding the number of slits which the encoder sensor 6005 detects. An encoder speed information conversion section 6006 is a unit for calculating the current driving speed of the line feed motor from a signal of the encoder sensor 6005 and a clock included in the recording apparatus.

A numerical value, which is obtained by subtracting an actual physical position obtained by the position information conversion section 6009 from the ideal position profile 6001, is delivered to a feedback processing of the position servo carried out in a processing 6002 or thereafter, as a positional error indicating shortage in relation to the target position. The processing 6002 is a major loop of the position servo, and a method of calculation related to proportional term P is commonly known for that purpose.

As a result of the calculation carried out in the processing 6002, a speed command value is outputted. The speed command value is delivered to feedback processing of the speed servo carried out in a processing 6003 or thereafter. As a minor loop of speed servo, a method carried out by a PID calculation which handles a proportional term P, an integral term I, and a differential term D is commonly known. In this embodiment, in order to improve the tracking in a case where a nonlinear variance of the speed command value occurs and in order to avoid detrimental effects of differential calculation in tracking control, a method commonly referred to as a "PID control method" is utilized. In this method, encoder speed information obtained by an encoder speed information conversion section 6006 undergoes a differential calculation 6007 before a difference between the encoder speed information and the speed command value obtained in the processing 6002 is calculated. The method itself is not the subject matter of the present invention, and depending on the characteristic of the system of the controlled object, it is sometimes enough to carry out only the differential calculation in the processing 6003.

In the minor loop of the speed servo, a numerical value, which is obtained by subtracting the encoder speed information from the speed command value, is delivered to a PI calculation circuit of the processing 6003, as a speed error indicating shortage in relation to a target speed, and then the energy to be applied to the DC motor at that time is calculated with a method called "PI calculation". A motor drive circuit, in response to the result of the calculation, with a constant voltage applied to motor, for example, using a unit for modulating a pulse width of the applied voltage (hereinafter referred to as PWM (Pulse Width Modulation) control), modulates a duty of the applied voltage, adjusts a current value, and the energy to be applied to the DC motor 6004 to carry out a speed control.

The DC motor 6004, which is rotated with the current being applied, physically rotates while being affected by an external disturbance 6008, and an output of the DC motor is detected by the encoder sensor 6005.

Figure 6:
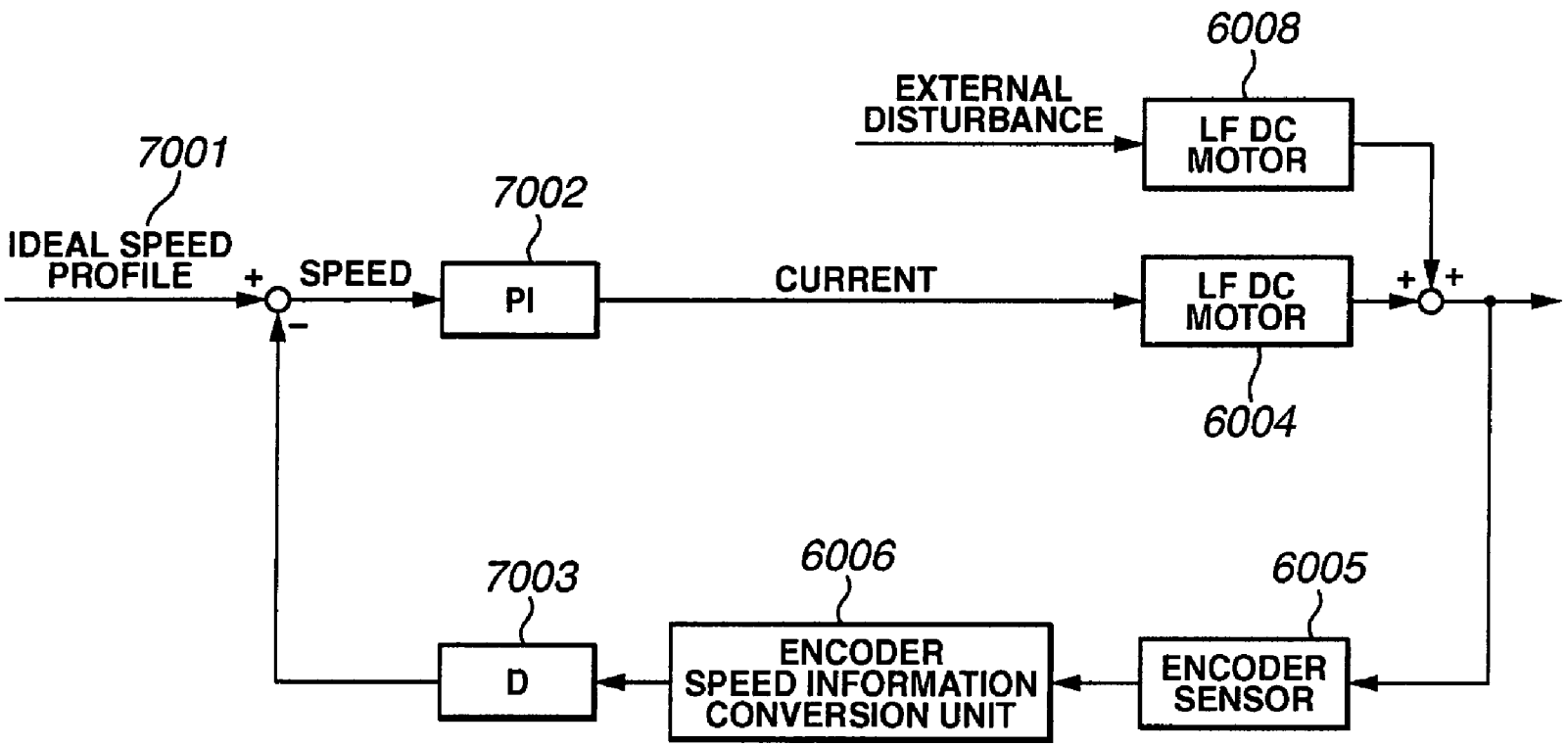
FIG. 6 is a schematic diagram explaining a speed control system of a DC motor according to the embodiment.

FIG. 6 is a schematic diagram explaining a speed control system of a common DC motor, which shows a method of carrying out the speed servo. In this embodiment, the speed servo is used in a positioning control region. The DC motor is controlled by the method called "PID control" or "classical control". The method is explained below.

First, a target speed to be applied to a controlled object is given in a form of an ideal speed profile 7001. In this embodiment, the ideal speed profile 7001 is an ideal speed at which the sheet should be conveyed by a line feed motor at a relevant time, and is a speed command value at the time. The speed information varies as the time passes. The driving of this embodiment is carried out by a tracking control to the ideal speed profile.

As for the speed servo, a method carried out by a PID calculation which handles a proportional term P, an integral term I, and a differential term D is commonly known for that purpose. In this embodiment, in order to improve the tracking in a case where a nonlinear variance of the speed command value occurs and to avoid detrimental effects of the differential calculation in tracking control, a method commonly referred to as a "PID control method" is utilized. In this method, encoder speed information obtained by the encoder speed information conversion section 6006 undergoes the differential calculation of a processing 7003 before a difference between the encoder speed information and the speed command value obtained in the ideal speed profile 7001 is calculated. The method itself is not the subject matter of the present invention, and depending on the characteristic of the system of the controlled object, it is sometimes enough to carry out only the differential calculation in the processing 7002.

In the speed servo, a numerical value, which is obtained by subtracting the encoder speed information from the speed command value, is delivered to a PI calculation circuit in the processing 7002, as a speed indicating shortage in relation to the target speed, and then the energy to be applied to the DC motor 6004 at that time is calculated with a method called "PI calculation". The motor drive circuit, in response to the result of the calculation, using the PWM control for example, modulates a duty of the applied voltage, adjusts a current value, and the energy to be applied to the DC motor 6004 to carry out speed control.

The DC motor 6004, which is rotated with the current value being applied, physically rotates while being affected by the external disturbance 6008, and an output of the DC motor 6004 is detected by the encoder sensor 6005.

Figure 7:
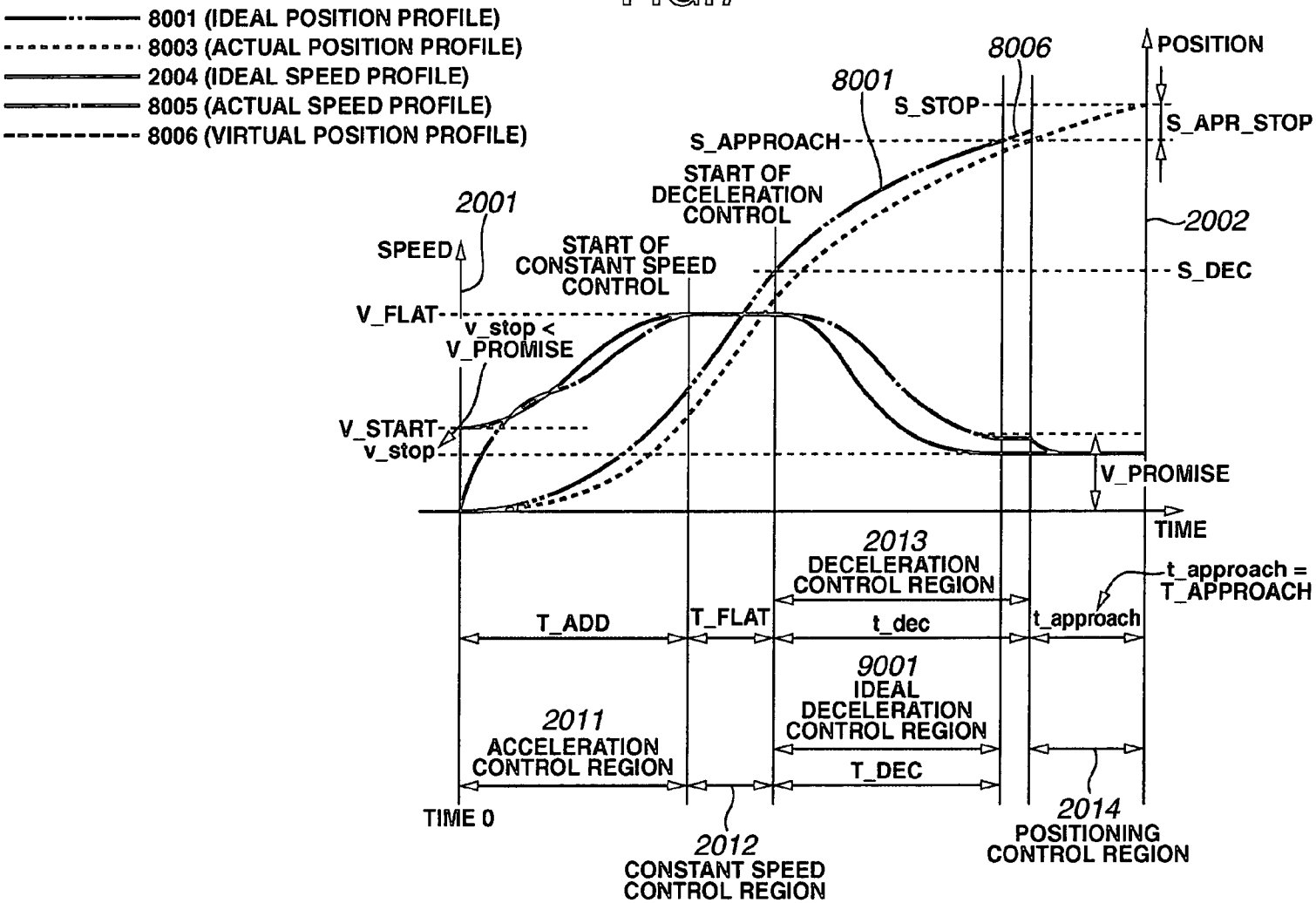
FIG. 7 is a conceptual view showing an effect from external disturbance on a control according to the embodiment.
Figure 8:
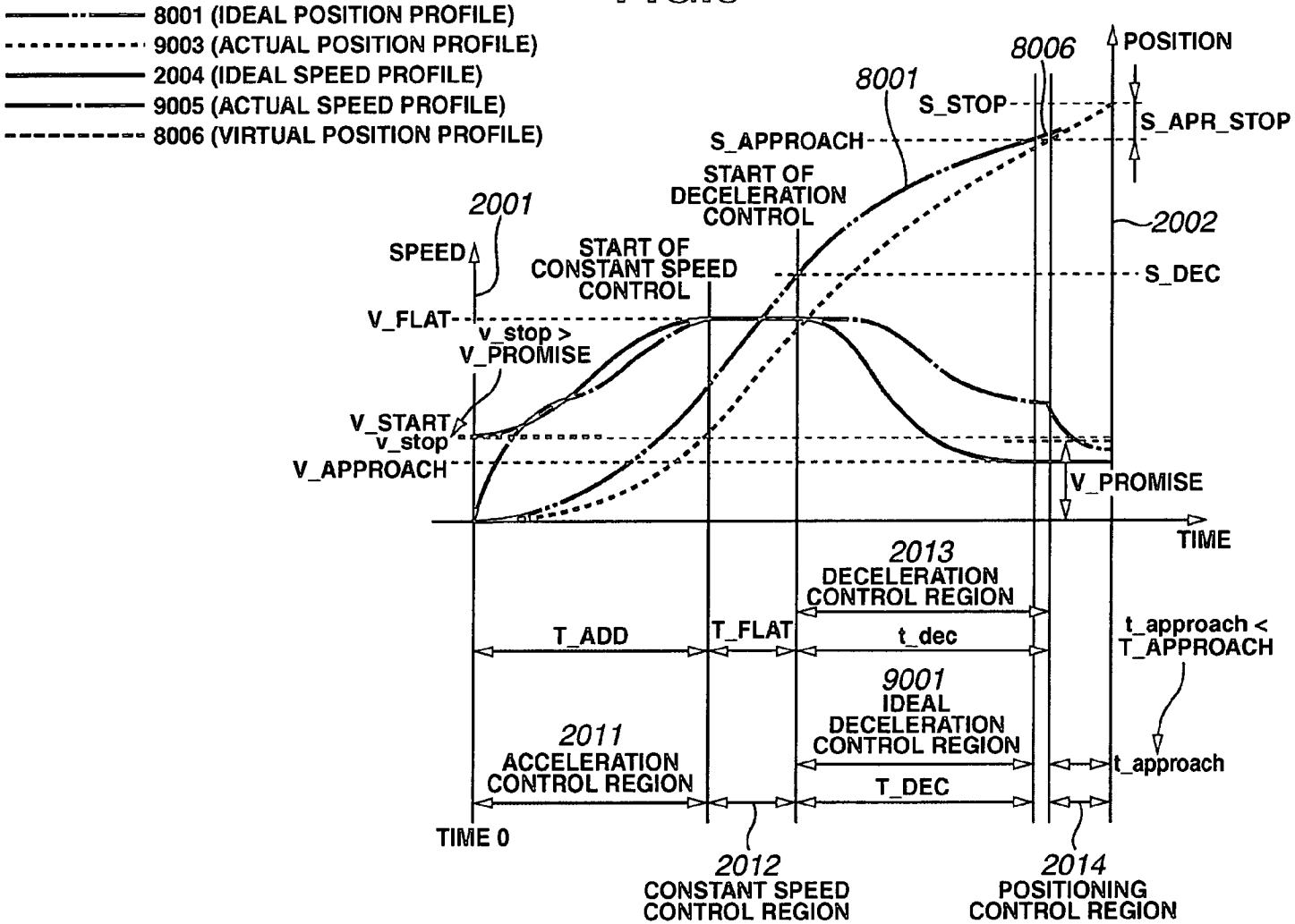
FIG. 8 is a conceptual view showing an effect from external disturbance on a control according to the embodiment.
Figure 9:
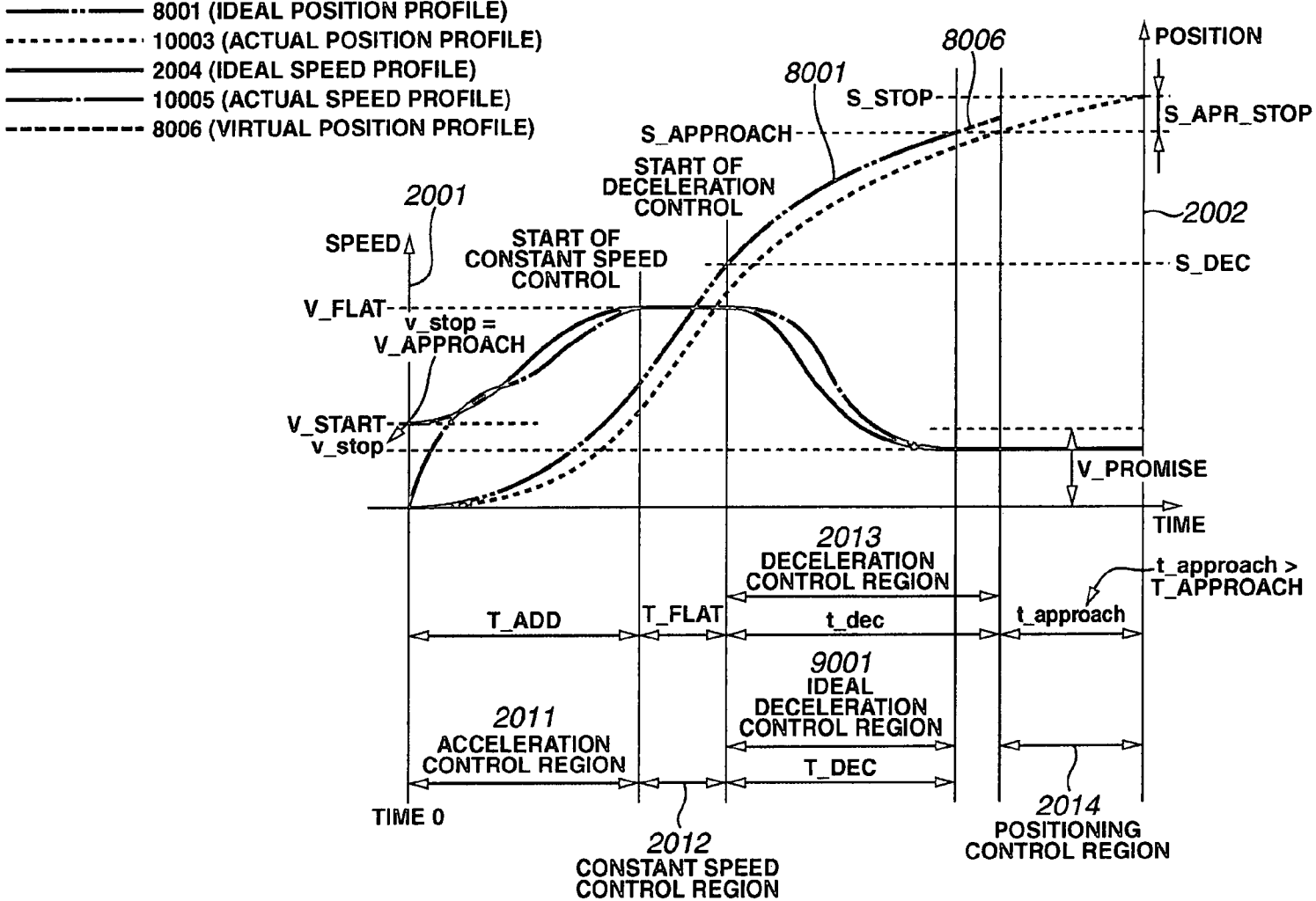
FIG. 9 is a conceptual view showing an effect from external disturbance on a control according to the embodiment.

FIGS. 7, 8, and 9 explain actually in detail about effects from and a control of the external disturbance in the LF control in this embodiment. A horizontal axis shows time. A vertical axis 2001 shows a speed, and a vertical axis 2002 shows a position.

FIG. 7 shows a case wherein a speed v_stop stops at an average and ideal value V_APPROACH (t_approach=T_APPROACH) FIG. 8 shows a case wherein t_approach<T_APPROACH, that is, the speed v_stop stops earlier than the expected time. FIG. 9 shows a case wherein t_approach>T_APPROACH, that is, the speed v_stop stops later than the expected time.

Reference numeral 8001 denotes an ideal position profile; and reference numeral 2004 denotes an ideal speed profile. The ideal position profile 8001 is constituted by four control regions, namely, an acceleration control region 2011, a constant speed control region 2012, a deceleration control region 2013, and a positioning control region 2014.

In the ideal speed profile 2004, V_START indicates an initial speed, V_FLAT indicates a speed in the constant speed control region 2012, V_APPROACH indicates a speed in the positioning control region, V_PROMISE indicates a maximum speed immediately before stop, which must be always kept to achieve the positioning accuracy. V_stop indicates a speed immediately before stop as an actual value that changes to any value due to the external disturbance in a case where actual driving is assumed. In consideration of variance in speed in actual driving, the speed V_APPROACH must be set to a sufficiently small value such that the speed v_stop does not exceed the value V_PROMISE, even when any variance in speed occurs.

In this embodiment, the position servo is employed in the acceleration control region 2011, the constant speed control region 2012, and the deceleration control region 2013, and the speed servo is employed in the positioning control region 2014. The curve 8001 shown in FIGS. 7, 8, and 9 represents the ideal position profile in the position servo. The curve 2004 shown in FIGS. 7, 8, and 9 represents the ideal speed profile in the case of the speed servo, and a required speed profile obtained for following the ideal position profile in the case of the position servo.

The ideal position profile 8001 is set in each of the regions 2011, 2012, and 2013 for the position servo, however, it is calculated only until S_APPROACH. This is because the ideal position profile is unnecessary from S_APPROACH because control is switched to the speed servo from S_APPROACH. A time T_DEC required for deceleration in the ideal position profile 8001 is constant independently of the actual driving. A control region corresponding to the time T_DEC is indicated by an ideal deceleration control region 9001.

Reference numerals 8003, 9003, and 10003 respectively denote the actual position profiles in the state affected by the external disturbance in each of the FIGS. 7, 8, and 9. In the position servo, since a delay always occurs in the servo, the actual position profiles 8003, 9003, and 10003 have delays with respect to the ideal position profile 8001. Hence, even when the ideal position profile 8001 is ended, the actual position does not reach S_APPROACH in general. In this embodiment, a virtual ideal position profile 8006 is used as the commanded position value directed to position servo after the ideal position profile 8001 is ended until actual driving reaches S_APPROACH. The virtual ideal position profile 8006 is indicated by a straight line extended from the end of the ideal position profile 8001 using the final gradient of the ideal position profile 8001.

Reference numerals 8005, 9005, and 10005 denote actual driving speed profiles of the physical motor. When feedback control is executed using the ideal position profile 8001 as an input, the speed becomes closer to the ideal speed as the positioning control region 2014 comes close to the end, although a slight delay is developed with respect to the ideal speed profile. The final speed immediately before stop converges to the speed V_APPROACH at which the positioning accuracy can be achieved. Note that the deceleration control region 2013 is shifted to the positioning control region 2014 at the moment when the position has reached S_APPROACH independently of the physical driving speed state.

S_DEC represents a position at which the constant speed control region 2012 is ended and the deceleration control region 2013 starts. Since S_DEC is a value determined by the ideal position profile 8001, it has nothing to do with the effect of the external disturbance in actual driving.

S_APPROACH in FIGS. 7, 8, and 9 indicates a position at which the deceleration control region 2013 ends and the positioning control region 2014 starts. S_STOP indicates a stop position. T_ADD indicates a time required for the acceleration control region 2011. T_DEC indicates a time required for the deceleration control region 2013. T_FLAT indicates a time required for the constant speed control region 2012 and is a fixed value which is determined when the stop position S_STOP at the time the driving start position is defined as 0 is set, that is, when the ideal position profile 8001 satisfying the total moving distance is set. T_APPROACH is a time required for the positioning control region 2014. T_APPROACH is a time required for the controlled object to move over a distance S_APR_STOP from the position S_APPROACH to head into the positioning control region 2014 to the stop position S_STOP when the object actually moves. FIG. 7 shows a case wherein the drive-controlled object has moved through the positioning region substantially at the ideal speed. However, in actual control, the ideal physical operation is generally very difficult to perform.

For high-speed and accurate positioning, the curve of the ideal position profile 8001 must be appropriately tuned in accordance with the system. More specifically, the ideal position profile 8001 is preferably set such that the speed in the constant speed control region 2012 is as high as possible to improve the time required for the positioning required time so far as the system performance permits. Further, the speed in the positioning control region 2014 should be as low as possible to improve the positioning accuracy so far as the system performance permits, and the lengths of the acceleration control region 2011, deceleration control region 2013, and positioning control region 2014 should be as short as possible to improve the performance of the positioning required time so far as the system performance permits. However, the present invention is not directed to a more detailed method for the tuning, accordingly, a description will be made herein assuming that the ideal position profile 8001 has already been optimized.

t_approach is an actual variable value of a time required for the positioning control region 2014 that changes to any value depending on external disturbance when actual driving is assumed. Note that in this embodiment, a constant value is indicated by upper-case letters, and a variable value is indicated by lower-case letters. When values with the same spelling are represented by both upper- and lower-case letters, the value indicated by upper-case letters represents an ideal constant value, and the value indicated by lower-case letters represents a variable value that can fluctuate.

Next, a method of driving a plurality of conveyance rollers by a plurality of servo control driving sources in this embodiment is explained.

With respect to rotation control of the U-turn conveyance rollers 205 and 206, which are disposed at the upstream side of the sheet conveyance path, and rotation control of the LF conveyance roller 4, which is disposed at the downstream side of the sheet conveyance path, respectively, the aforementioned control is independently applied. In this regard, for ideal profiles which are control target, the same profile is set. In a case where there are differences in roller diameters and resolutions of roller surfaces, profiles are set in consideration of a deceleration ratio, so that roller surface feed distances coincide with one another.

Ideally, it is enough to maintain a state of a balance between a conveyance resistance (conveyance load) generated on the U-turn conveyance path of the segment in which the recording paper P is conveyed by the U-turn conveyance rollers 205 and 206 and a conveyance force of the U-turn conveyance rollers 205 and 206. That is, in a case where the recording paper P is conveyed through the U-turn conveyance path region, corresponding to the region in which the recording paper P is conveyed only by the LF conveyance roller 4, if an external force 0, in which the conveyance force is balanced with the conveyance resistance, is applied to the LF conveyance roller 4, there will be no variance in a conveyance amount by the LF conveyance roller 4.

It is difficult to always maintain a state in which there is balance between the conveyance resistance generated on the U-turn conveyance path and the conveyance force of the U-turn conveyance rollers 205 and 206, however, it is possible to create a state similar to the above state of balance if a shape of the U-turn conveyance path, a coefficient of friction of the U-turn conveyance guide section, a coefficient of friction of each of the rollers and a pressing force of a driven roller, namely the conveyance force, and stiffness (rigidity) and a coefficient of friction of a conveyed sheet are known.

In this embodiment, the two U-turn conveyance rollers 205 and 206 convey the recording paper P on the U-turn conveyance path, however, the same method can be applied with one U-turn conveyance roller, which is included in the scope of the present invention.

In this embodiment, variance in the conveyance resistance of a position at (or region in) which the trailing edge of the recording paper P exists, in a case where the recording paper P is conveyed within the conveyance path, is explained by referring to FIGS. 10 through 14. FIGS. 10 through 14 show that the recording paper P is conveyed by the LF conveyance roller 4 and the U-turn conveyance rollers 205 and 206.

Figure 10:
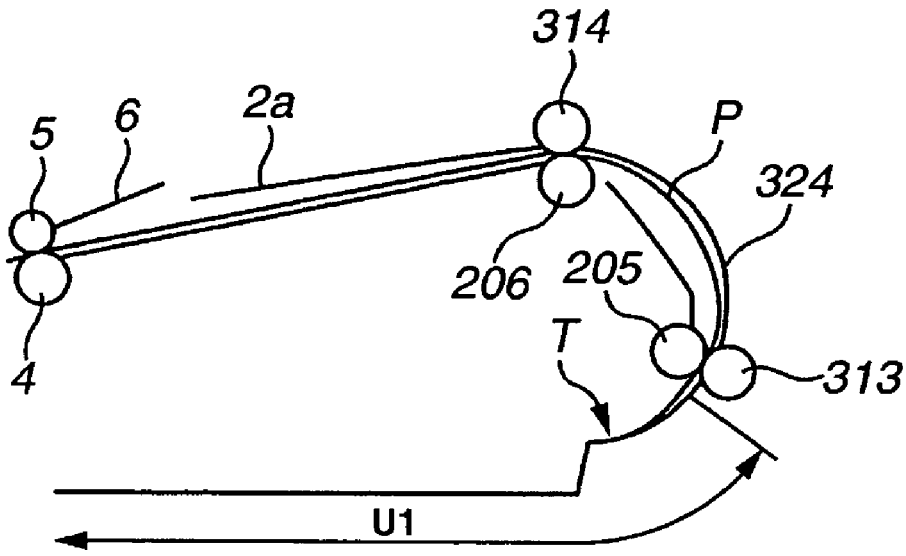
FIG. 10 is a view explaining a state of conveyance of recording paper according to the embodiment.
Figure 13:
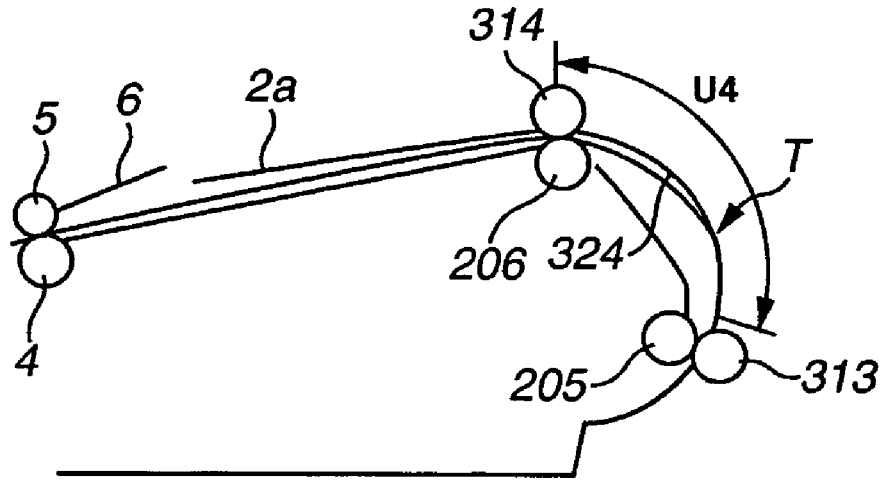
FIG. 13 is a view explaining a state of conveyance of the recording paper according to the embodiment.
Figure 14:
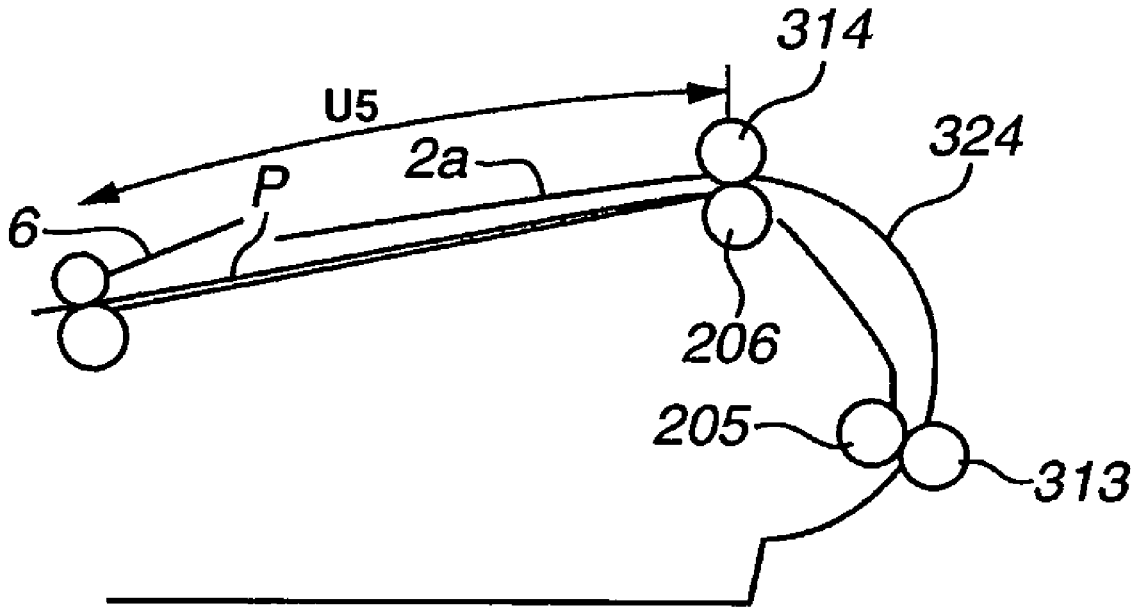
FIG. 14 is a view explaining a state of conveyance of the recording paper according to the embodiment.

FIG. 10 shows that the trailing edge of the recording paper P exists at a position upstream (in the direction of conveyance) of the conveyance roller 205. FIG. 13 shows that the trailing edge of the recording paper P exists between the conveyance roller 206 and the conveyance roller 205. FIG. 14 shows that the trailing edge of the recording paper P exists at a position downstream (in the direction of conveyance) of the conveyance roller 206.

In FIG. 10, the conveyance resistance does not vary much in a state where the trailing edge of the recording paper P exists in a region U1. The closer the trailing edge of the recording paper P gets to the first U-turn conveyance roller 205, the closer comes a touching point T between the recording paper P and the rear guide 324, however, the conveyance resistance does not vary much because a bending angle of the recording paper P gets smaller. Here, a boundary of the region U1 at the downstream side in the direction of conveyance is where the recording paper P is separated from the rear guide 324.

Figure 11:
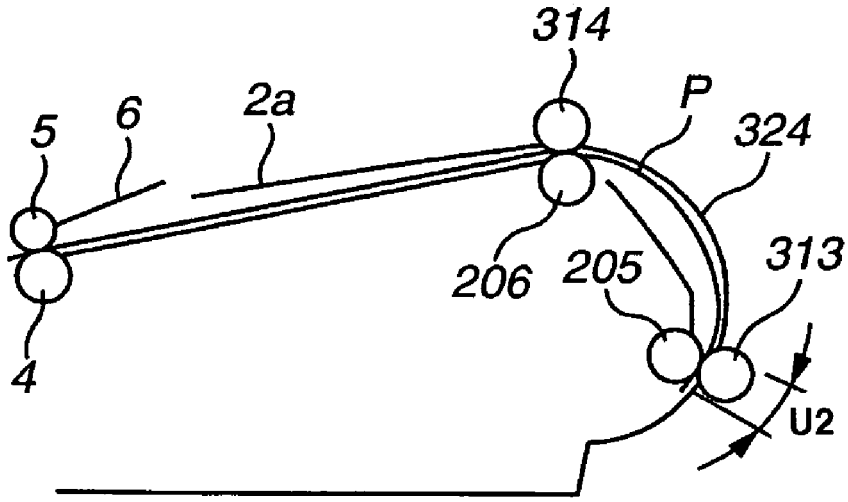
FIG. 11 is a view explaining a state of conveyance of the recording paper according to the embodiment.

After that, as shown in FIG. 11, in a region U2 in which the recording paper P is separated from the guide section, the conveyance resistance decreases as the trailing edge of the recording paper P is separated from the rear guide 324 in accordance with the protruding quantity of the first U-turn pinch roller 313 from the rear guide 324.

Figure 12:
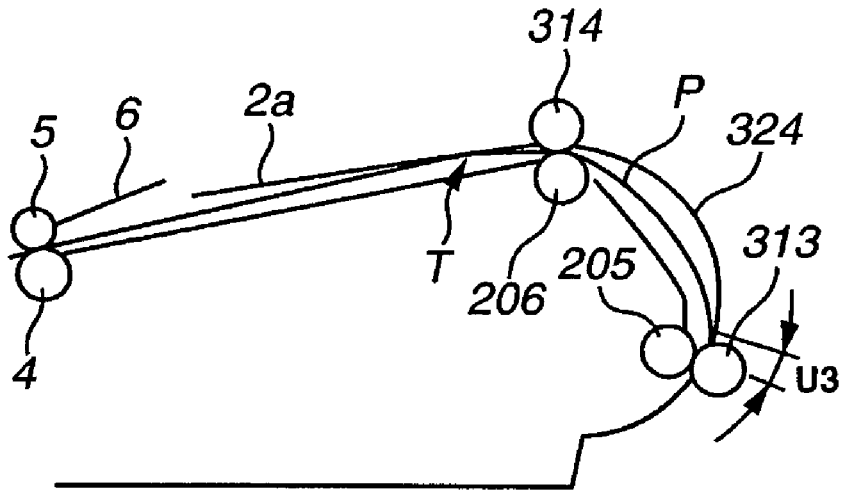
FIG. 12 is a view explaining a state of conveyance of the recording paper according to the embodiment.

Then, as shown in FIG. 12, immediately after the recording paper P passes the first U-turn conveyance roller 205 and passes the first U-turn pinch roller 313, which is a rotary object, a high resistance is generated on the trailing edge of the recording paper P due to restoring force by stiffness of the recording paper P. In addition, at a position T on a downstream side of the second U-turn pinch roller 314, the conveyance force of the first U-turn conveyance roller 205 is lost when the recording paper P touches the sheet guide 2*a*. Hence, a high conveyance resistance is generated (in a region U3). Here, the conveyance resistance in a region differs before and after the recording paper P passes the first U-turn conveyance roller 205.

After that, as shown in FIG. 13, in a region U4, in a state wherein the bending angle of the recording paper P gets small and the conveyance resistance disappears at the position T, as the trailing edge of the recording paper P comes closer to the second U-turn conveyance roller 206, the touching point T between the recording paper P and the rear guide section becomes closer to the roller 206. However, the conveyance resistance does not vary much because a bending angle of the recording paper P gets smaller.

Then, as shown in FIG. 14, in a region U5, which is a region after the recording paper P passes the second U-turn conveyance roller 206, the conveyance resistance is stable because no resistance is applied from a U-turn shaped conveyance path and no conveyance force is applied from the U-turn conveyance roller 206. However, in the vicinity of a point at which the recording paper P passes the second U-turn conveyance roller 206, no variance of the conveyance resistance occurs because the direction of passage of the recording paper P from the U-turn conveyance roller 206 and the direction in which the sheet is fed is identical (this is because the second U-turn roller 206 and the second U-turn pinch roller 314 are disposed at a contact point of a tangential line of a virtual U-turn circle touching the nip of the LF conveyance roller 4). However, difference in the conveyance resistances appears before and after the point at which the recording paper P passes the nip of the second U-turn conveyance roller 206. This is because the conveyance resistance of the U-turn conveyance path which has been applied abruptly disappears.

The aforementioned variance in the conveyance resistance occurs in accordance with the shape of the U-turn sheet guide, the number and the arrangement of the U-turn conveyance roller, quantity of protrusion of the U-turn pinch roller, and the direction of passage (the direction of conveyance) of the recording paper P from the pinch roller. The conveyance resistance in accordance with an embodiment is individually grasped and reflected to a conveyance control.

Figure 15A:
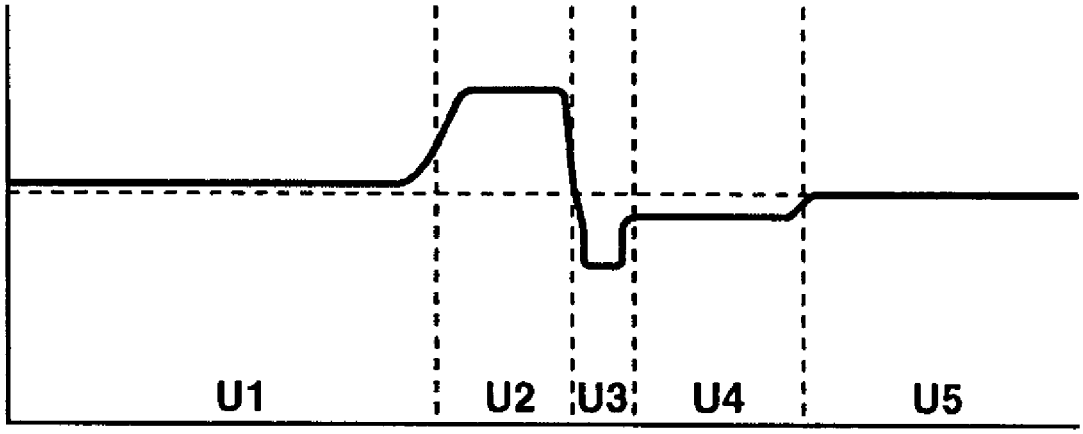
FIGS. 15A and 15B are views explaining the variance of a conveyance amount of the recording paper according to the embodiment.
Figure 15B:
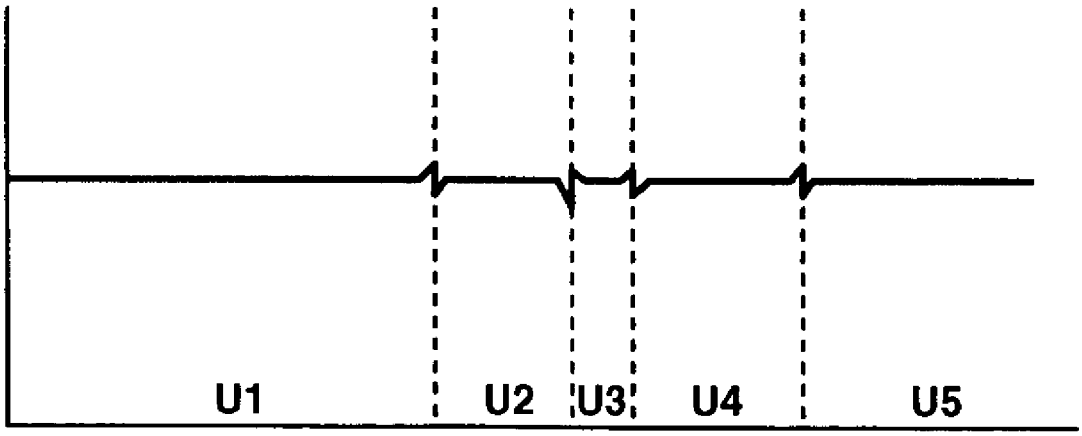

In order to reduce the effect of the variance of conveyance resistance on the conveyance amount of the LF conveyance roller 4, a correction value is set to a feeding amount of the U-turn conveyance rollers 205 and 206 to perform a variable setting per region. In FIGS. 15A and 15B, variance in the conveyance amount of the LF conveyance roller 4 (to be more precise, variance in extra-conveyance force including loss in spring pressure of the pinch roller) according to the conveyance resistance in FIGS. 10 through 14 is schematically shown. In FIGS. 15A and 15B, the horizontal axis indicates a conveyance region and the vertical axis indicates variance in the conveyance amount.

Improvement is made from the state shown in FIG. 15A to the state shown in FIG. 15B by setting a correction value to the feeding amount of the U-turn conveyance rollers 205 and 206 and performing a variable setting per region.

This variable control is carried out as explained below. The correction value of the conveyance amount of the U-turn conveyance rollers 205 and 206 in the regions U1 and U2 in which amount of LF conveyance is large is set to a small value in relation to the conveyance amount in the region U5 in which the recording paper P is conveyed only by the LF conveyance roller 4, so that the conveyance resistance is applied to the LF conveyance roller 4

In addition, in the regions U3 and U4 in which the amount of LF conveyance is small, the correction value of the conveyance amount of the U-turn conveyance rollers 205 and 206 is set to a large value so that the conveyance amount of the U-turn conveyance rollers 205 and 206 becomes closer to the amount of LF conveyance in the region U5. With this setting, the conveyance resistance in relation to the LF conveyance roller 4 can be reduced.

To give a supplementary explanation on the aforementioned correction value of the conveyance amount, for example, the correction value elongates (changes the length of) the constant speed control region 2012 explained in FIG. 7. Otherwise, a length of the positioning control region 2014 explained in FIG. 7 may be changed.

A control system is preferably configured to compute the correction value in advance on the basis of the types and kinds of the recording paper P to be conveyed and to select the correction value in accordance with a command to select the type of the recording paper of a printer driver designated by a user. Or, a control system may be configured to select the correction value in accordance with a result of detection by a sensor for detecting the type of the sheet. Thus, the appropriate correction value can be set to the various types of the recording paper of different stiffness.

As shown in FIG. 15B, there exist regions in which slight variance occurs (discontinuities), in the boundary of each of the regions. In the boundary region, the regions may be divided into smaller segments so that each of the correction values can be gradually changed. By this way of controlling, the conveyance amount of the LF conveyance roller 4 can be further stabilized.

In this regard, it is significant to variably set the correction value of the feeding amount of the U-turn conveyance rollers 205 and 206. The first reason for that is that the conveyance amount of the U-turn conveyance rollers 205 and 206 can be adjusted in a wide range. On the other hand, if the conveyance amount of the LF conveyance roller 4 is corrected, a result of the correction appears directly. Therefore, it is possible that an accuracy of conveyance is degraded if the correction deviates from an appropriate position.

Thus, an easier and more stabilized conveyance control can be carried out when the correction is made to the U-turn rollers 205 and 206, because the U-turn rollers 205 and 206 are not so much affected, and accordingly, a large correction amount can be set to them.

The second reason for that is that the movement of the recording paper P being conveyed can be more stabilized. That is, if the correction is carried out only by the LF conveyance roller 4, in a case where the conveyance resistance is high, namely, where the conveyance amount by the U-turn rollers 205 and 206 is small, the recording paper P is pulled between the LF conveyance roller 4 and the U-turn conveyance rollers 205 and 206. In addition, the LF conveyance roller 4 further pulls the recording paper P to enlarge the conveyance amount. On the other hand, in a case where the conveyance resistance is low, if correction is carried out in this state, the LF conveyance roller 4 applies more pressure in order to reduce the conveyance amount. Thus, if the recording paper P is affected in such a manner, the movement of the recording paper P cannot be stabilized. Especially, it becomes difficult to stabilize the variance in the amount of LF conveyance when the trailing edge of the recording paper P passes the U-turn conveyance rollers 205 and 206. Besides, if too much pulling or too much pressure is applied to the recording paper P, it is possible that the desired correction cannot be obtained because of possible large deviation from linearity of the correction in the vicinity of the breaking point. Also for these reasons, the correction is made on the conveyance amount of the U-turn conveyance rollers 205 and 206.

In this embodiment, as described above, the correction value of the U-turn conveyance rollers 205 and 206 is variably set for each of the segments of the regions in which the conveyance resistance is generated. As a unit for determining the changing point of the segments, the second sheet position detection sensor lever 330 is used.

In response to the result of detection of the position of the trailing edge of the recording paper P, at a timing (conveyance position) which the second sheet position detection sensor lever 330 detects as a base point, the correction value of the U-turn conveyance rollers 205 and 206 is changed when the trailing edge of the recording paper P is conveyed to the aforementioned changing point of the regions U1 through U5.

In this regard, it is necessary to dispose the second sheet position detection sensor lever 330 at the upstream side, in the direction of conveyance, at least from the position of the U-turn pinch rollers 313 and 314, at which an abrupt variance in the conveyance amount occurs. Thus, by using the timing (position of conveyance) at which the second sheet position detection sensor lever 330 detects the trailing edge of the recording paper P, the point at which the conveyance amount varies can be precisely determined.

Figure 16A:
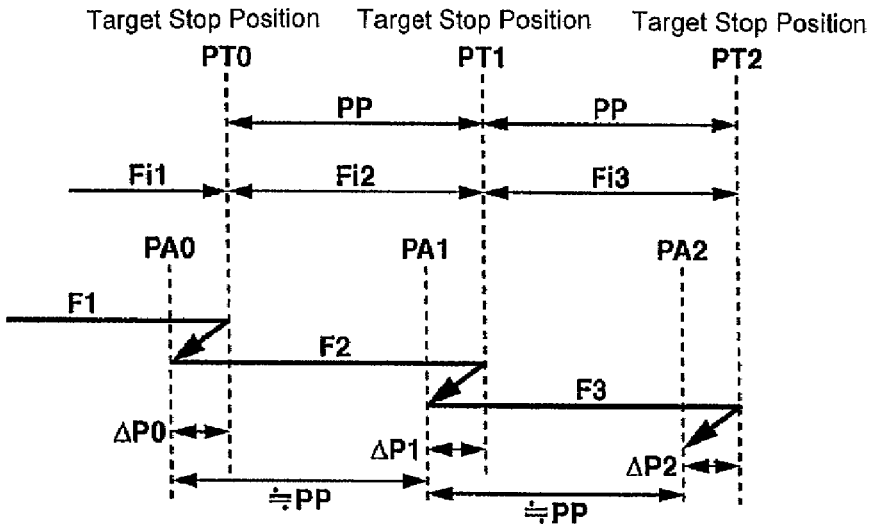
FIGS. 16A and 16B are views explaining the movement of the recording paper when the recording paper is stopped according to the embodiment.
Figure 16B:
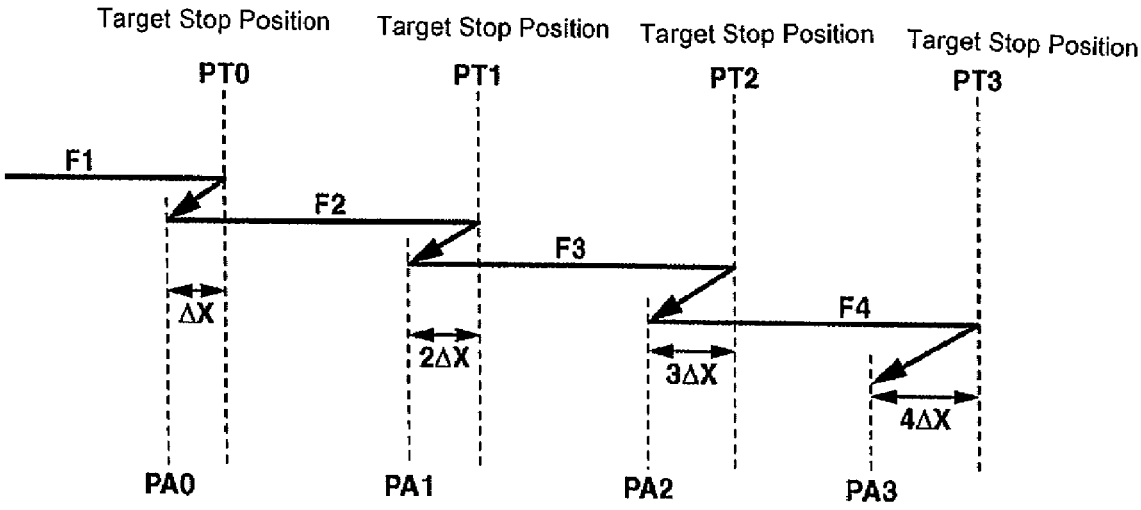

In addition to the correction on the conveyance amount, in order to avoid a cumulative deviation of the correction amount, a threshold value for changing the base point of the feeding command of the U-turn conveyance is set. This is explained by referring to FIGS. 16A and 16B. FIGS. 16A and 16B show how the recording paper P moves from left to right. The arrow indicates the movement of the recording paper P. Symbols F1 through F4 respectively indicate one conveyance operation.

In FIG. 16A, ideally, the recording paper P stops at ideal stop positions PT0, PT1, and PT2, respectively, by conveyance operations Fi1 through Fi3. However, in actuality, in an operation F1, the recording paper P stops at a position PA0, deviating from a (an ideal) target position PT0 by ΔP0, due to charge and the like of the driving system and the stiffness of the recording paper P (the arrow indicates that the recording paper P advances to the stop position PT0 but returns by ΔPO and stops at the position PA0: this is because the U-turn conveyance rollers 205 and 206 stop at a position coffesponding to the stop position PT0 and because after that, they stop at the position PA0 by returning by an amount corresponding to ΔPO).

Therefore, in order to keep a feeding length pitch PP constant regardless of the effect from variance of the stop position of the recording paper P, the target stop position PT1, at which the next conveyance operation stops, is computed not on the basis of the position in accordance with the position PA0 at which the recording paper P actually stops, but on the basis of the previous target stop position PT0. That is, a position obtained by adding the pitch PP to the previous target stop position PT0 (PT0+PP) is regarded as the target stop position PT1 at which the next conveyance operation stops, and a conveyance (F2) is carried out with the conveyance amount for that stop position.

Thus, as shown in FIG. 16A, if a deviation ΔP1 occurs and the recording paper P stops at a position PA1, because the deviation ΔP0 and the deviation ΔP1 are substantially equal, the distance between the stop position PA1 and the stop position PA0 (the distance between PA0 and PA1) and the distance between the target stop position PT0 and the target stop position PT1 (the distance between PT0 and PT1) is substantially equal. In the same way, the next target stop position PT2 is (PT1+PP).

Incidentally, when the conveyance control is carried out in this way, in a case where the conveyance amount of the U-turn conveyance rollers increases and the correction value is set too large, the feeding amount of the U-turn conveyance roller becomes too large in relation to the LF conveyance roller. Accordingly, the stop position of the U-turn conveyance roller is returned.

As shown in FIG. 16B, if a return amount ΔX is not so large in one conveyance operation, the return amount of a second conveyance operation is 2ΔX (the amount twice as large as ΔX), and the return amount of a third conveyance operation is 3ΔX (the amount three times as large as ΔX). For that reason, the U-turn conveyance roller is returned in a large amount. Thus, the deviation of the actual stop position of the recording paper P from the ideal stop position of the recording paper P becomes gradually larger. In other words, the error of the stop position of the recording paper P is accumulated.

Figure 19:
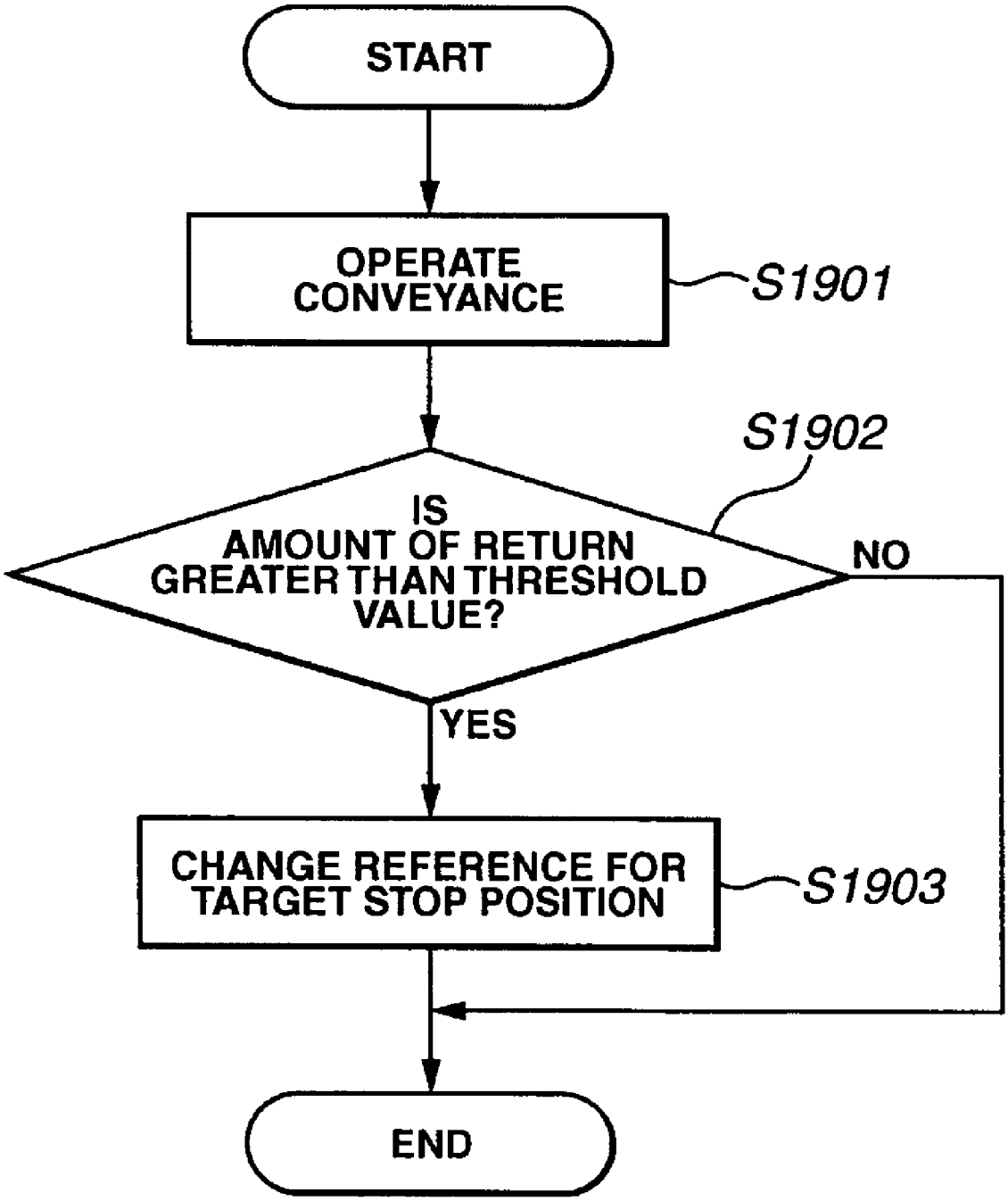
FIG. 19 is a flow chart explaining a conveyance control of the recording paper according to the embodiment.

In this regard, an outline of control for eliminating the accumulation of errors is explained with reference to FIG. 19. Namely, the return amount is compared with the threshold value when the conveyance operation is carried out, and a reference for the target stop position is changed if the return amount is larger than the threshold value. By this processing, the accumulation of the errors of the position of conveyance is eliminated. In order to implement this, the following processings are carried out per one conveyance operation, for example. In a step S1901, the conveyance operation is carried out. In a step S1902, it is determined whether or not the return amount exceeds the threshold value. If the return amount is larger than the threshold value (Yes in S1902), the reference for the target stop position is changed in a step S1903. If it is determined that the return amount is not larger than the threshold value (No in S1902), the reference for the target stop position is not changed and retained.

Figure 17A:
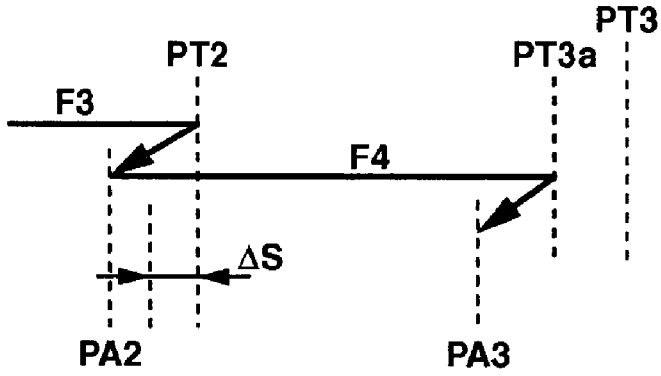
FIGS. 17A through 17C are views explaining a conveyance control of the recording paper according to the embodiment.

One example of the aforementioned control is explained below. First, the return amount is compared with a specific threshold value ΔS. The amount of return of the U-turn conveyance roller is computed by counting the number of slits of the encoder. If the return amount becomes larger than the threshold value ΔS, a target stop position PT3*a* is set by adding the conveyance amount PP, with a position PA2 at which the recording paper P actually stops as the reference, as shown in FIG. 17A. That is, the reference for the target stop position is changed.

By this way of controlling, the distance between the position PA2 and a position PA3 (the feeding amount by the conveyance operation F4) becomes substantially the same as the feeding length pitch PP, and in addition, accumulation of the amount of deviation, in other words, an excessive return amount, can be canceled.

Even in a case where a value of the actual stop position PA2 is larger, in the direction of conveyance, than the specific threshold value ΔS in relation to the target stop position PT2, contrary to the case described above, the conveyance operation is carried out by setting the target stop position to the downstream side of the direction of conveyance by a desired feeding length pitch PP, with the actual stop position PA2 as the reference, just as in the case described above. Thus, accumulation of deviation due to overfeeding can be canceled.

Figure 17B:
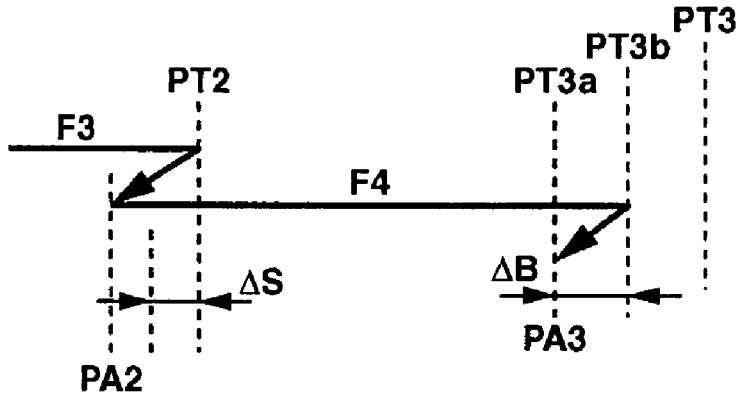

Next, a second example of the control for eliminating the accumulation of errors is explained. In this control, in a case where the return amount is larger than the threshold value ΔS, as shown in FIG. 17B, a target stop position PT3*b* is set by adding the assumed amount of return ΔB to the conveyance amount PP, with the position PA2, at which the recording paper P actually stops, as the reference. Thus, the recording paper P can be stopped nearer to the target stop position PT3*a*. The amount of return ΔB is, for example, the threshold value ΔS or a value obtained empirically.

Figure 17C:
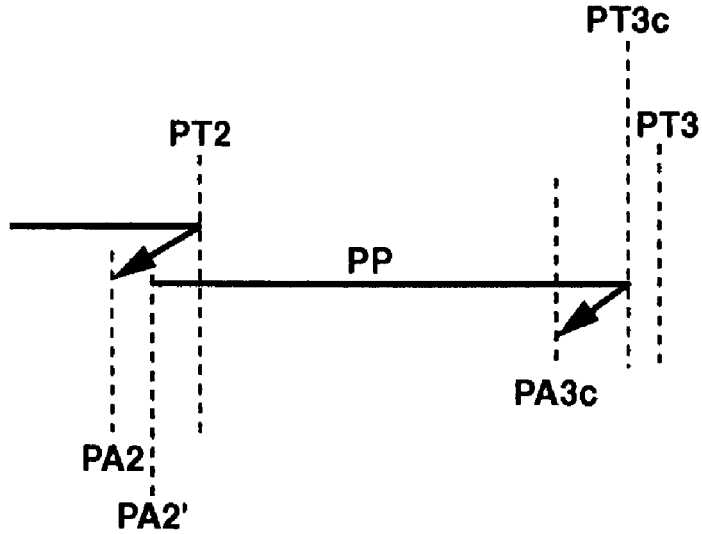

Next, a third example of control for eliminating the accumulation of errors is explained. In this control, in a case where the return amount is larger than the threshold value ΔS, as shown in FIG. 17C, a target stop position PT3*c* is determined by adding the conveyance amount PP, with a prescribed position between the position PA2 at which the recording paper P actually stops and the target stop position PT2 as the base point (PA2'). In addition, the amount of return ΔB may be added to the conveyance amount PP.

By carrying out the control like this, it becomes possible to limit the deviation of the correction value due to unevenness of parts and the like within a tolerance. In addition, it becomes possible to prevent a severe deterioration of accuracy. Besides, on the contrary, it becomes possible to make more correction of the conveyance amount by utilizing the cumulative charge of the errors of the conveyance amount. In this case, the control for changing the value of the threshold value ΔS is carried out. More specifically, it is preferable that the threshold value ΔS is set large at the point where a large correction of the conveyance amount is desired, and the threshold value ΔS is set small at the point where a small correction of the conveyance amount is desired.

Further, in addition to these, difference in level (difference between the region U4 and the region U5) of the conveyance resistance (conveyance amount) when the recording paper P passes the second U-turn conveyance roller 206 is caused mainly by the deviation of the stop position due to release of elastic charge force by the aforementioned driving system and the stiffness of the recording paper P. Further, the difference in level of the conveyance resistance when the recording paper P passes the second U-turn conveyance roller 206 is caused because the amount of deviation of the stop position differs in the LF conveyance roller 4 and the U-turn conveyance rollers 205 and 206. In the driving operation according to this embodiment, it has been confirmed that there arises a return of about 4 μm in the rotation conveyance amount by the LF conveyance roller. On the other hand, with regard to the conveyance return amount in the case of the U-turn conveyance, it has been confirmed that there arises a return of more than 20 μm in the rotation conveyance amount by the U-turn conveyance roller. The primary cause for this is that the recording paper P is bent by the conveyance path of the U-turn conveyance path in relation to the U-turn conveyance rollers 205 and 206, and thus a restoring force generated by the bent shape is added when conveyance of the recording paper P is stopped.

Figure 18A:
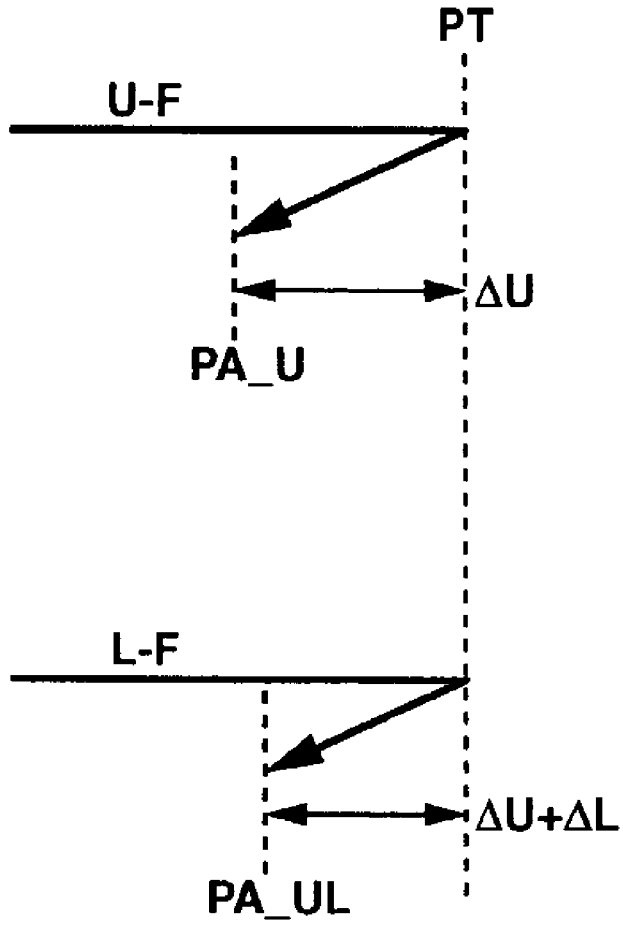
FIGS. 18A and 18B are views explaining the movement of the recording paper when the recording paper is stopped according to the embodiment.

That is, as shown in FIG. 18A, in a case where the recording paper P is conveyed by the LF conveyance roller 4 and the U-turn conveyance rollers 205 and 206, even if both the LF conveyance roller 4 and the U-turn conveyance rollers 205 and 206 concurrently perform a stopping operation at the specific target stop position PT, because the U-turn conveyance roller is reversely rotated by ΔU and stops at a position PA_U, the LF conveyance roller receives the external disturbance via the recording paper P and a reverse rotation amount becomes (ΔL+ΔU). As a result, the LF conveyance roller stops at a position PA_UL. This state continues until the trailing edge of the printing sheet (recording paper P) passes the U-turn conveyance roller.

Figure 18B:
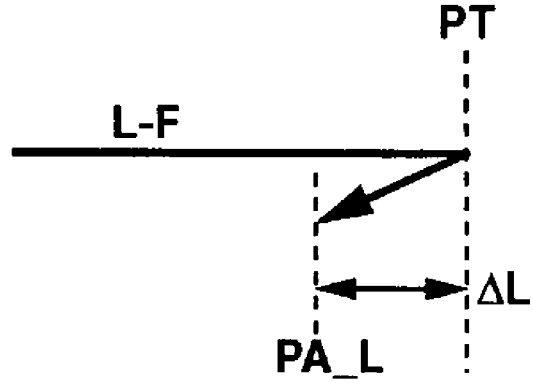

However, after the trailing edge of the recording paper P has passed the U-turn conveyance roller, the external force to the U-turn conveyance roller is resolved. Consequently, as shown in FIG. 18B, the LF conveyance roller stops at a stop position PA_L, after reversely rotating by ΔL.

Assuming that the external return force of the U-turn conveyance roller is constant, the feeding pitch in a case where the recording paper P is conveyed by the U-turn conveyance roller and the LF conveyance roller and the feed pitch in a case where the recording paper P is conveyed only by the LF conveyance roller are equal, however, there arises a deviation by the amount (ΔLU−ΔL) of the conveyance amounts before and after the point where the recording paper P passes the U-turn conveyance roller.

In order to prevent the deviation of the conveyance amount from occurring, a very small driving force, balanced with the elastic force which generates the return, is continuously applied to the U-turn conveyance motor 32, without shutting off the power supply which is supplied to the motor (current supplied to the motor), under the state in which the U-turn conveyance rollers 205 and 206 reach the slit to stop there. The driving force is applied in the direction of conveyance. Thus, the returning of the U-turn conveyance rollers 205 and 206 can be prevented. Hereafter, the very small driving force to be applied in the direction of conveyance is called "forward brake".

However, actually, the return force is uneven. Accordingly, in a case where the generated conveyance resistance is lower than expectation in relation to the prescribed forward brake, it is possible that the conveyance rollers rotate in the direction of conveyance. In order to prevent this problem, a drive stop point is newly set in a state in which the forward brake is applied beyond the target stop position in the direction of conveyance. More specifically, an encoder slit beyond a target stop slit (point) of the encoder is set as a secure slit. In an ordinary case, it is effective to set a slit as a secure slit which is positioned beyond the target stop slit by 5 to 10 μm.

In the present embodiment, the drive stop point is provided as a check on a case wherein too much forward brake is applied. However, in order to prevent the return in a case where the power supply is shut down at the checkpoint, it is effective to switch to a driving force smaller than the driving force of the forward brake which has been applied. In this case, as a further check on the forward brake which is changed to a small value, the driving force is further reduced or the power supply to the motor is shut off.

The values such as the correction value of the conveyance amount of the U-turn conveyance, the threshold value for switching the control, the forward brake force, and a parameter of the secure slit position are previously determined in accordance with the type of the recording paper, positional information of the recording paper P, and the like, and are stored in a memory provided in the control unit (control circuit). Or, the control parameter mentioned above may be obtained by externally inputting information on the type of the recording paper P and the like by a host apparatus and the like.

Thus, by appropriately varying the control parameter in accordance with the specification and state of the conveyance path, the characteristic and size of the conveyed object (recording paper) and the like, it becomes possible to reduce the effect from the conveyance resistance (conveyance load) which varies on the conveyance path, in relation to various types of the recording paper of different stiffness, and also, it is possible to improve the accuracy of the conveyance amount of the LF conveyance roller 4.

Next, with regard to the servo control of the two motors, namely the LF conveyance motor 25 and the U-turn conveyance motor 32, as described above, the LF conveyance roller 4 is primarily controlled, and the U-turn conveyance rollers 205 and 206 are secondarily controlled.

First, a servo parameter of the driving motor 25 of the LF conveyance roller 4 is determined regardless of the operation of the driving motor 32 of the U-turn conveyance rollers 205 and 206. The servo parameter of the LF conveyance motor 25 is determined so that the LF conveyance roller 4 is optimally controlled in a state in which the recording paper P is conveyed only by the LF conveyance roller 4. Accordingly, the servo parameter of the LF conveyance motor 25 is basically the same as the parameter which is used in the conveyance operation of a case where the recording paper is fed in the ASF sheet feed to carry out printing (recording) thereon. On the other hand, with regard to the servo parameter of the U-turn conveyance motor 32 which controls the operation of the U-turn conveyance rollers 205 and 206, a less strong control is applied so that the control of the LF conveyance roller 4 and the LF conveyance motor 25 is not affected much. As one example, the gain of the proportional term is set low.

In order to make the operation of the U-turn conveyance rollers 205 and 206 as ideal as possible, the gain should be set so high that the effect from the external disturbance is eliminated. However, because the U-turn conveyance rollers 205 and 206 are subject to the conveyance resistance of the U-turn shaped path, in which the external disturbance is high, even if the operation of the U-turn conveyance rollers 205 and 206 is ideally controlled, the feeding amount of the recording paper P by the U-turn conveyance rollers 205 and 206 varies in accordance with the conveyance resistance. As a result, it is not possible to feed the recording paper P with an ideal amount of conveyance. In addition, the insusceptibility to the external disturbance means that the two control systems are mutually connected with the recording paper P, and accordingly, the difference between the conveyance amount of the recording paper P and the feeding amount of the U-turn conveyance rollers 205 and 206, which is one type of the external disturbance, is easily applied to the primarily-controlled LF conveyance roller 4.

Generally, the gain of the servo is set as high as possible within the range in which oscillation does not occur. However, with regard to the U-turn conveyance motor 32, the gain of the servo is determined so that the control and the operation profile of the LF conveyance motor 25 are affected as less as possible. That is, it is preferable that the U-turn conveyance motor 32 operates in accordance with the operation of the recording paper P, which is conveyed by the control by the LF conveyance motor 25. Accordingly, the control gain of the U-turn conveyance motor 32 is set at a small value.

Under the control condition like this, it is preferable that a timing to instruct the startup of the U-turn conveyance motor 32 is set identical to a timing to instruct the startup of the LF conveyance motor 25 to synchronize the timings of startup of these two motors and that the actual movement is automatically determined because the tracking of the U-turn conveyance motor 32 is disturbed in accordance with the condition of the recording paper P.

In the present embodiment, the method as mentioned above can be applied not only to printing in the case of U-turn feeding but also to a case of automatic both side printing similarly. In this case, if the conveyance resistance is the same as that of U-turn feeding, the method as mentioned above can be applied as it is. However, if there is a region in which the conveyance resistance differs in a both side conveyance path, the parameter may be set in accordance with the region. In addition, because the length of the recording paper is determined by the first sheet position detection sensor lever 318, the position of the trailing edge of the recording paper P can be recognized before the recording paper P reaches the second sheet position detection sensor lever 330.

As stated above, by the control of the U-turn conveyance roller, it becomes possible to suppress the variance of the conveyance resistance or conveyance force arising due to the shape of the conveyance path and the arrangement of the U-turn conveyance roller, the effect from the conveyance resistance charge force, and the external disturbance arising due to the control. As a result, the variance of the conveyance amount of the conveyance roller can be reduced so as to achieve a high image quality printing. Note that the shape of the conveyance path is not limited to the U-turn shaped path, nor is the state in which the recording paper P touches the guide section (the rear guide section and the like) limited to the case described above.

Second Embodiment

A main constitution of the recording apparatus in a second embodiment of the present invention is identical to the constitution as explained in the first embodiment, and accordingly, explanation is omitted herein.

In the second embodiment, as a unit for recognizing the position of the trailing edge of the recording paper P, the sheet length from a printer driver is used. It is possible to grasp the position of the trailing edge of the recording paper P on the basis of the sheet length from the printer driver, the actually fed amount of conveyance, and a shape of the conveyance path which is previously determined. Thus, it becomes possible to appropriately set the parameter even in the region in which the trailing edge of the recording paper P exists at the upstream side of the second sheet position detection sensor lever 330 in the direction of conveyance. It is also possible to achieve a similar effect with a lower cost by eliminating the second sheet position detection sensor 330.

In addition, the threshold value for switching the correction value and the base point position of the feeding amount of the U-turn conveyance roller is set as a function or a table in relation to the trailing edge position of the recording paper P, instead of region segmentation of the threshold value. Thus, it becomes possible to carry out an effective control in a case where the conveyance resistance or the conveyance force is too complex to obtain an approximation with the method in which there are several regions. Accordingly, variance in the conveyance amount at the LF conveyance roller 4 is reduced so as to achieve a high image quality printing.

Moreover, there is a case wherein the conveyance amount of the LF conveyance roller 4 and the U-turn conveyance rollers 205 and 206 becomes uneven due to tolerances of the diameter of the parts of them. In this regard, it is possible to reduce the effect by changing and setting the correction value of the conveyance amount by a test conveyance carried out before shipment or by a user. More specifically, the correction value in this case is obtained from an output history of a U-turn conveyance encoder about the test conveyance of the recording paper of which a friction coefficient and stiffness (rigidity) is previously known. That is, in a case where the return amount at the stop is large in relation to an output value of the U-turn conveyance encoder which is previously estimated, the conveyance amount of the U-turn conveyance roller 205 is larger than that of the LF conveyance roller 4. Accordingly, it is enough to add a conveyance amount correction value for decreasing evenly the U-turn conveyance amount in accordance with the level of the return amount of the output value of the U-turn conveyance encoder. On the other hand, in a case where the return amount is small in relation to the output value of the U-turn conveyance encoder, it is enough to add the conveyance amount correction value for increasing the conveyance amount. Especially, in a case where the correction value is changed and set by the test conveyance which is carried out by the user, it becomes possible to obtain an appropriate feeding amount even in various operation conditions in which the roller diameter varies due to change in the temperature and the like and the friction resistance of the roller changes with passage of time. Thereby, a stable and high-quality output image can be provided.

Other Embodiments

As described above, the conveyance of the recording medium in the inkjet recording apparatus has been explained in the first embodiment and the second embodiment, however, the present invention may be applied also to an electrophotographic recording apparatus. In addition, the present invention may be applied to an image input apparatus, a copying machine, and the like for reading a sheet type original.

While the present invention has been described with reference to exemplary embodiments, it is to be understood that the invention is not limited to the disclosed embodiments. On the contrary, the invention is intended to cover various modifications and equivalent arrangements included within the spirit and scope of the appended claims. The scope of the following claims is to be accorded the broadest interpretation so as to encompass all such modifications and equivalent structures and functions.

This application claims priority from Japanese Patent Application No. 2004-220385 filed Jul. 28, 2004, which is hereby incorporated by reference herein.

What is claimed is:

1. A recording apparatus for conveying a recording medium by using a plurality of conveyance units in order to carry out recording on the recording medium by using a recording head, the recording apparatus comprising:

a first conveyance roller disposed at a downstream side of a conveyance path for conveyance of the recording medium and a second conveyance roller disposed at an upstream side of the conveyance path;

a first driving unit and a second driving unit configured to independently drive the first conveyance roller and the second conveyance roller, respectively; and a control unit configured to perform feedback control of the first driving unit based on amount of rotation of the first conveyance roller and to perform feedback control of the second driving unit based on amount of rotation of the second conveyance roller to perform conveyance of a predetermined amount, wherein the control unit defines a setting of driving control for amount of rotation of the second conveyance roller to be different from a setting of driving control for the amount corresponding to the amount of rotation of the first conveyance roller, and wherein a region for recordation on the recording medium by the recording head is provided at a downstream side of the first conveyance roller in the conveyance path of the recording medium.

2. A recording apparatus according to claim 1, wherein the recording apparatus further comprises a first encoder configured to count revolutions of the first conveyance roller and a second encoder configured to count revolutions of the second conveyance roller.

3. A recording apparatus according to claim 1, wherein the control unit changes a target stop position in a case where an amount of deviation of an actual stop position in relation to the target stop position reaches a predetermined threshold value.

4. A recording apparatus according to claim 1, wherein the control unit changes a reference for a target stop position in a case where an amount of deviation of an actual stop position in relation to the target stop position reaches a predetermined threshold value.

5. A recording apparatus according to claim 1, wherein the control unit controls the second driving unit to change an applied driving force for the second conveyance roller at a point of time when the second conveyance roller reaches a target stop position, and wherein the setting of driving control applied to the second conveyance roller is the applied driving force of the second driving unit at and after the point of time when the second conveyance roller reaches the target stop position.

6. A recording apparatus according to claim 5, wherein the driving force of the second driving unit at and after the point of time when the second conveyance roller reaches the target stop position is a driving force of rotation in a normal direction at such a level that the second conveyance roller does not rotate in a reverse direction at a stopping operation.

7. A recording apparatus according to claim 5, wherein the control unit controls the second driving unit to further change the applied driving force for the second conveyance roller which has been changed at the target stop position, and wherein a point at which the applied driving force is further changed by the second driving unit is located at a downstream side of the target stop position of the second conveyance roller in a direction of conveyance.

8. A recording apparatus according to claim 1, wherein the control unit changes the setting of driving control for the second conveyance roller in accordance with a position of a trailing edge of the recording medium in the conveyance path.

9. A recording apparatus according to claim 1, wherein the setting of driving control applied to the second conveyance roller is a control gain parameter, and wherein the control unit sets the control gain parameter at a small value in relation to a gain value for optimum control of only the second conveyance roller.

10. A recording apparatus according to claim 1, wherein the control unit controls a conveyance amount of the recording medium on the basis of an amount of rotation of the first conveyance roller.

11. A recording apparatus according to claim 1, further comprising a feeding roller for feeding the recording medium to the conveyance path.

12. A recording apparatus according to claim 1, further comprising a discharging roller at a downstream side of the first conveyance roller.

13. A recording apparatus according to claim 1, the predetermined amount corresponds to width that recorded by the recording head.

14. A recording apparatus according to claim 1, further comprising a third conveyance roller at an upstream side of the second conveyance roller.

15. A recording apparatus according to claim 14, wherein the conveyance path is divided into a plurality of regions, and driving the second conveyance roller is set based on the region where the rear end of a sheet is positioned.

* * * * *